US005697275A

United States Patent [19]

Lindee et al.

[11] Patent Number: 5,697,275

[45] Date of Patent: Dec. 16, 1997

[54] SLICING STATION, WITH SHEAR EDGE MEMBER, FOR A FOOD LOAF SLICING MACHINE

[75] Inventors: Scott A. Lindee, New Lenox; David M. Hansen, Orland Park, both of Ill.

[73] Assignee: Formax, Inc., Mokena, Ill.

[21] Appl. No.: 660,496

[22] Filed: Jun. 7, 1996

Related U.S. Application Data

[62] Division of Ser. No. 320,752, Oct. 11, 1994.

[51] Int. Cl.[6] ..... B26D 1/18; B26D 7/06

[52] U.S. Cl. ..... 83/355; 83/440.1; 83/444; 83/446; 83/449; 83/932

[58] Field of Search ..... 83/355, 409.1, 83/409.2, 417, 440, 440.1, 444, 446, 448, 449, 591, 595, 596, 698.61, 699.61, 409, 932, 592

[56] References Cited

U.S. PATENT DOCUMENTS

| | | | |
|---|---|---|---|
| 3,318,351 | 5/1967 | Werder | 83/446 X |
| 4,015,494 | 4/1977 | Spooner et al. | 83/77 X |
| 4,226,147 | 10/1980 | Kumzi | 83/77 X |
| 4,348,923 | 9/1982 | Huston et al. | 83/409.2 X |
| 4,405,186 | 9/1983 | Sandberg et al. | 83/77 X |
| 4,428,263 | 1/1984 | Lindee et al. | 83/354 |
| 4,580,475 | 4/1986 | Antonissen | 83/77 X |
| 4,598,745 | 7/1986 | Parviainen | 83/62.1 X |
| 4,685,364 | 8/1987 | Scheflow et al. | 83/355 X |
| 4,805,503 | 2/1989 | Yokokawa | 83/444 X |
| 4,913,019 | 4/1990 | Hayashi | 83/355 X |
| 5,054,345 | 10/1991 | Weber | 83/42 |
| 5,320,014 | 6/1994 | Skaar et al. | 83/444 X |

*Primary Examiner*—Eugenia Jones

*Attorney, Agent, or Firm*—Dorn, McEachran, Jambor & Keating

[57] ABSTRACT

A slicing station for a high speed food loaf slicing machine that slices one, two, or more food loaves simultaneously using one cyclically driven knife blade; the slices are stacked or shingled in groups on a receiving conveyor located below the slicing station. Independent loaf feed drives are provided so that slices cut from one loaf may be thicker than slices from the other. The slicing station, enclosed by a housing except for a limited slicing opening, includes a knife blade having an elongated arcuate cutting edge and a drive that moves the knife blade at a predetermined cyclic rate along a closed cutting path through the slicing range, which range intersects the ends of food loaves fed at predetermined rates into the slicing station. A marker moving with the blade is sensed by a fixed sensor to establish a home position for the blade. There is a honing device to sharpen the cutting edge of one type of blade, with the blade in its home position. A pressure seal is provided to preclude entry of hot water or steam into the slicing station during cleanup. A door mechanism closes off the slicing opening when no food loaf slices are to be cut. The slicing station includes a shear edge member to guide the end of a food loaf into the cutting path of the knife blade.

3 Claims, 14 Drawing Sheets

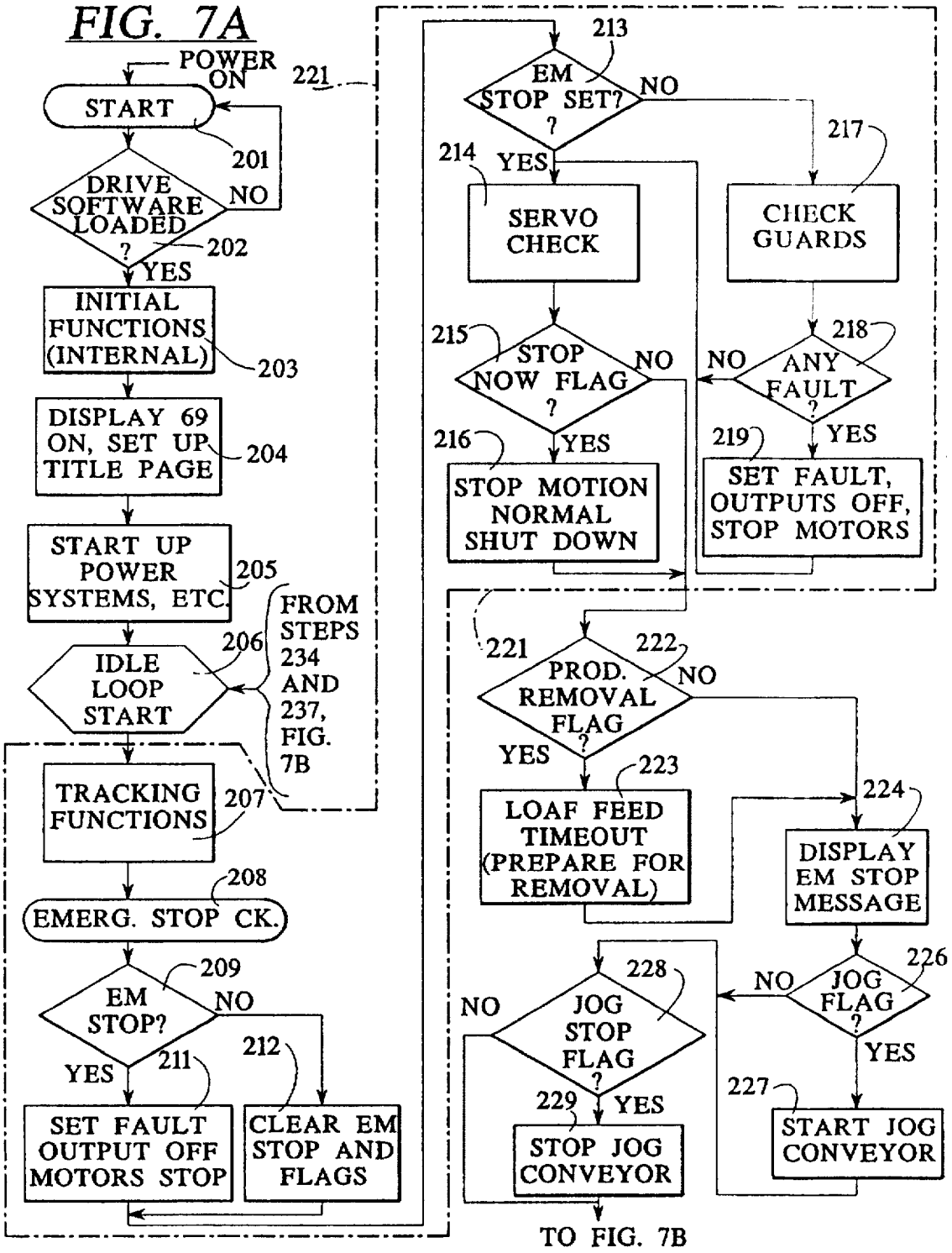
FIG. 7A
POWER ON
START
201
DRIVE SOFTWARE LOADED ?
NO
202
YES
INITIAL FUNCTIONS (INTERNAL)
203
DISPLAY 69 ON, SET UP TITLE PAGE
204
START UP POWER SYSTEMS, ETC.
205
IDLE LOOP START
206
FROM STEPS 234 AND 237, FIG. 7B
TRACKING FUNCTIONS
207
EMERG. STOP CK.
208
EM STOP?
209
NO
YES
211
212
SET FAULT OUTPUT OFF MOTORS STOP
CLEAR EM STOP AND FLAGS
221
EM STOP SET?
213
NO
YES
214
SERVO CHECK
217
CHECK GUARDS
215
STOP NOW FLAG ?
NO
YES
216
STOP MOTION NORMAL SHUT DOWN
218
ANY FAULT ?
NO
YES
219
SET FAULT, OUTPUTS OFF, STOP MOTORS
221
PROD. REMOVAL FLAG ?
222
NO
YES
223
LOAF FEED TIMEOUT (PREPARE FOR REMOVAL)
224
DISPLAY EM STOP MESSAGE
226
JOG FLAG ?
NO
YES
228
JOG STOP FLAG ?
NO
229
YES
STOP JOG CONVEYOR
227
START JOG CONVEYOR
TO FIG. 7B

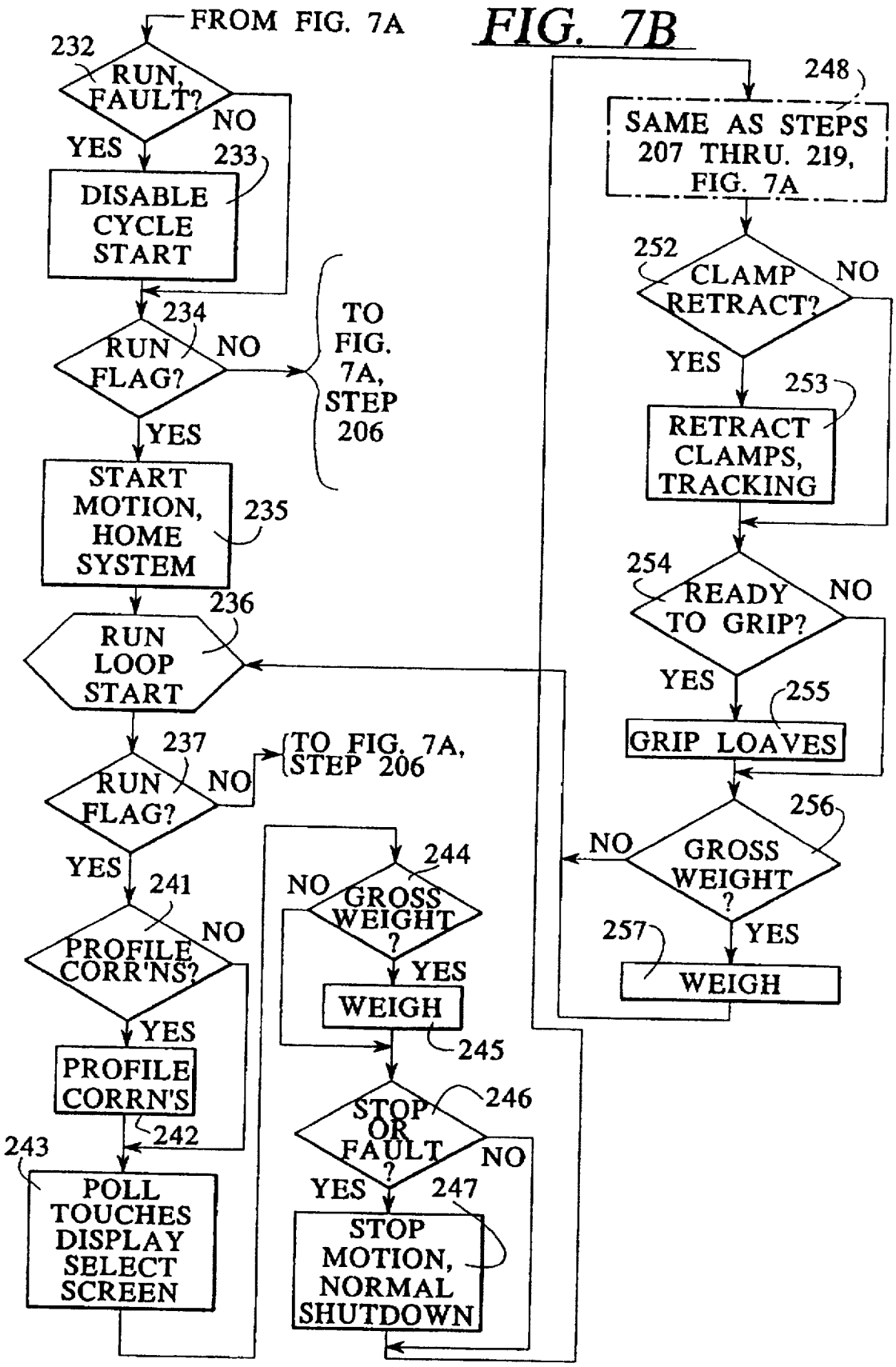
FIG. 7B
FROM FIG. 7A
232
RUN, FAULT?
NO
YES
233
DISABLE CYCLE START
234
RUN FLAG?
NO
TO FIG. 7A, STEP 206
YES
START MOTION, HOME SYSTEM
235
236
RUN LOOP START
237
RUN FLAG?
NO
TO FIG. 7A, STEP 206
YES
241
PROFILE CORR'NS?
NO
YES
PROFILE CORRN'S
242
243
POLL TOUCHES DISPLAY SELECT SCREEN
244
GROSS WEIGHT ?
NO
YES
WEIGH
245
246
STOP OR FAULT ?
NO
YES
247
STOP MOTION, NORMAL SHUTDOWN
248
SAME AS STEPS 207 THRU. 219, FIG. 7A
252
CLAMP RETRACT?
NO
YES
253
RETRACT CLAMPS, TRACKING
254
READY TO GRIP?
NO
YES
255
GRIP LOAVES
256
GROSS WEIGHT ?
NO
YES
257
WEIGH FIG. 15
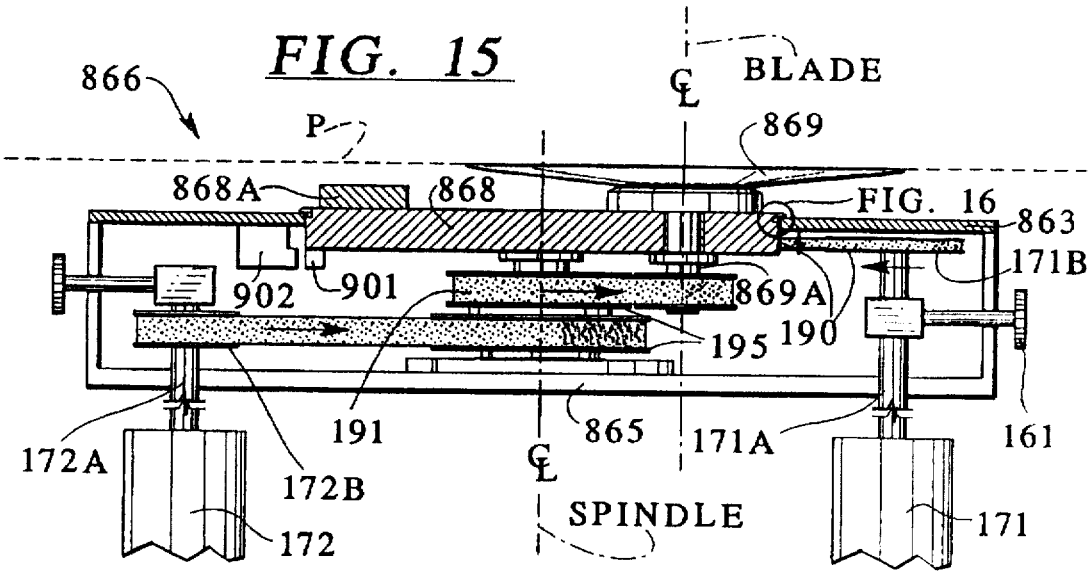
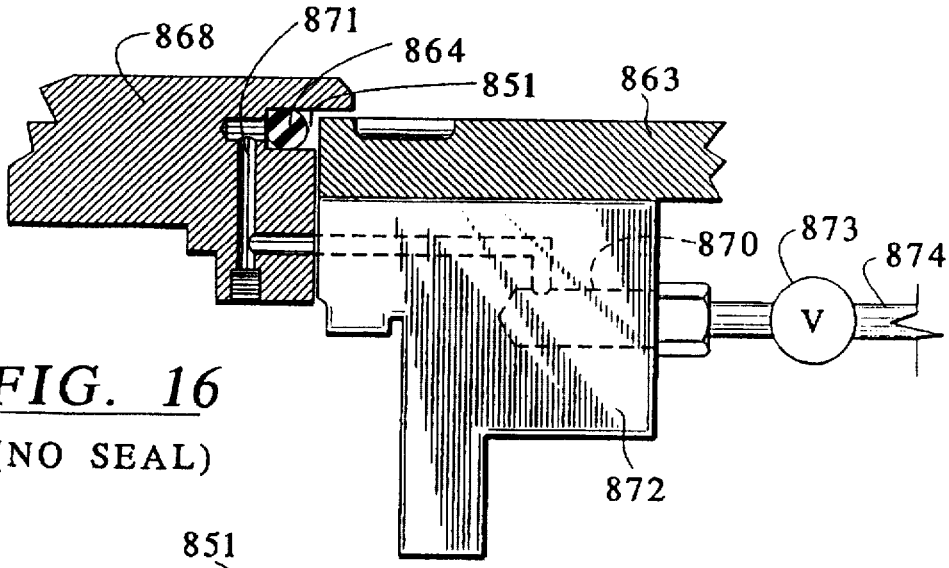
FIG. 16
(NO SEAL)
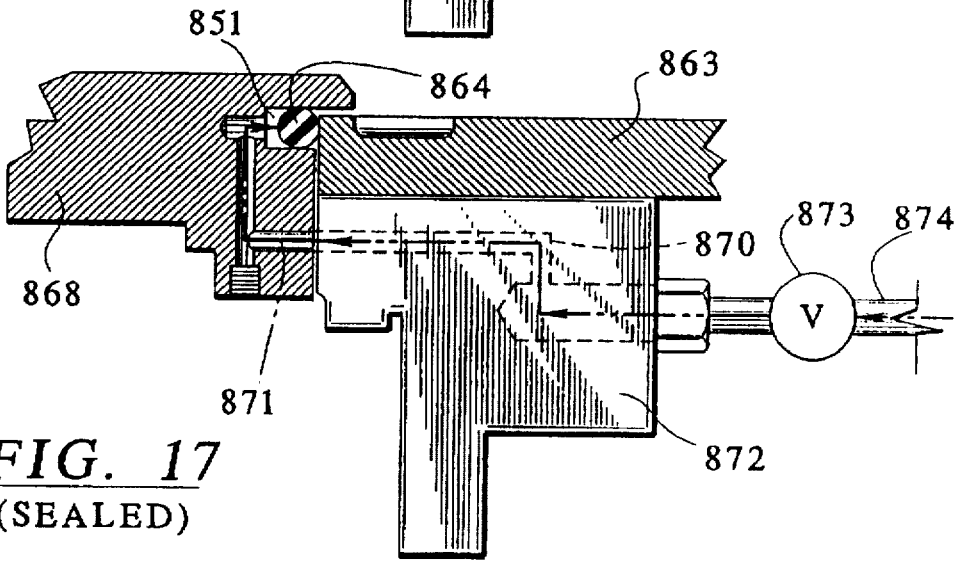
FIG. 17
(SEALED)

FIG. 18
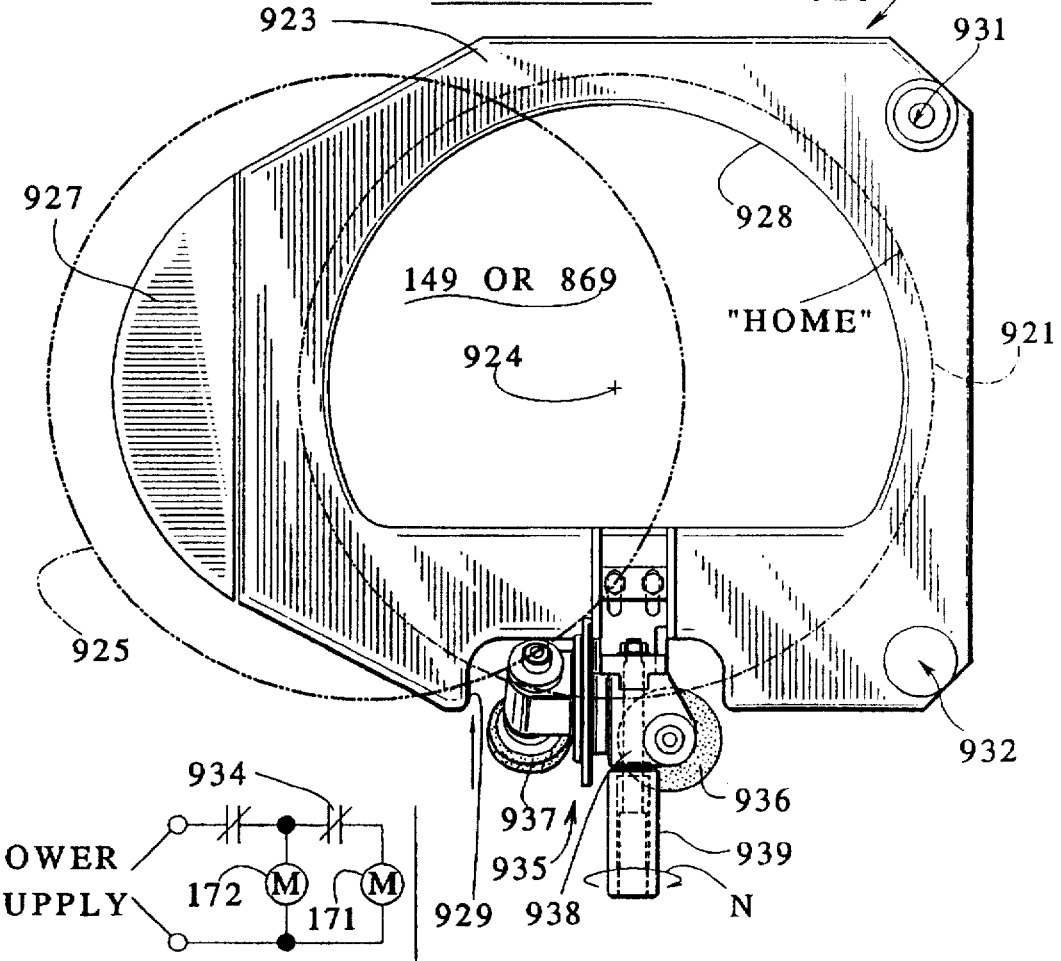
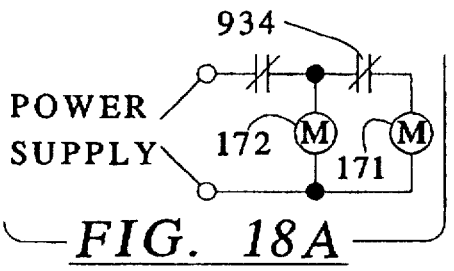
FIG. 18A
FIG. 19
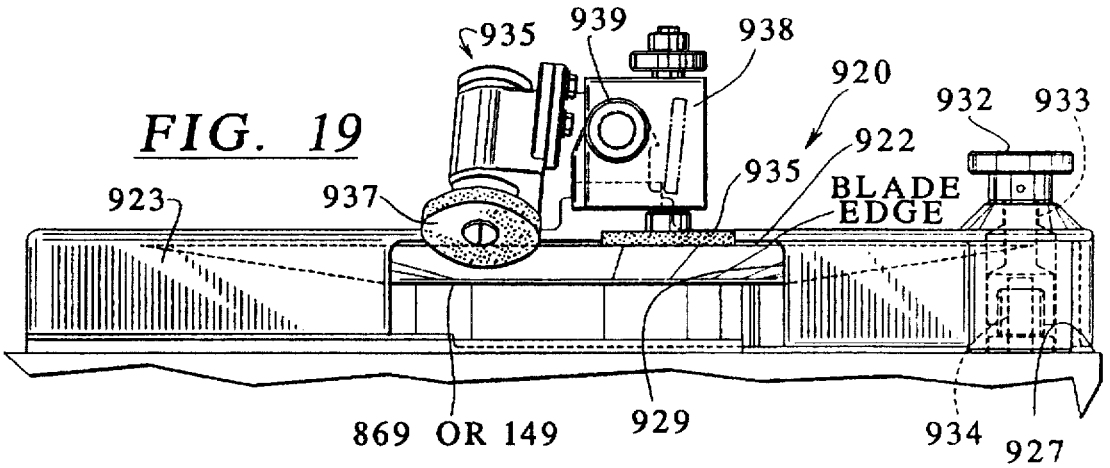

SLICING STATION, WITH SHEAR EDGE MEMBER, FOR A FOOD LOAF SLICING MACHINE

This is a divisional of copending application(s) Ser. No. 08/320,752 filed on Oct. 11, 1994 pending.

BACKGROUND OF THE INVENTION

Many different kinds of food loaves are produced; they come in a wide variety of shapes and sizes. There are meat loaves made from various different meats, including ham, pork, beef, lamb, turkey, fish, and even meats not usually mentioned. The meat in the food loaf may be in large pieces or may be thoroughly comminuted. These meat loaves come in different shapes (round, square, rectangular, oval, etc.) and in different lengths up to four feet (122 cm) or even longer. The cross-sectional sizes of the loaves are quite different; the maximum transverse dimension may be as small as 1.5 inches (4 cm) or as large as ten inches (25.4 cm). Loaves of cheese or other foods come in the same great ranges as to composition, shape, length, and transverse size.

Many of these food loaves meet a common fate; they are sliced, the slices are grouped in accordance with a particular weight requirement, and the groups of slices are packaged and sold at retail. The number of slices in a group may vary, depending on the size and consistency of the food loaf and even on the whim of the producer, the wholesaler, or the retailer. For some products, neatly aligned stacked slice groups are preferred. For others, the groups are shingled so that a purchaser can see a part of every slice through a transparent package. When it comes to bacon or other food products of variable shape, the problems do not just increase; they literally multiply.

A variety of different known slicing machines have been used to slice food loaves. They range from small, manually fed slicers used in butcher shops and in retail establishments to large, high speed slicers usually employed in meat processing plants. The present invention is directed to a slicing station for a high speed slicing machine of the kind used in a meat processing plant.

Some known high speed food loaf slicing machines have provided for slicing two food loaves simultaneously with a single, cyclically driven knife blade. Other prior high speed slicing machines, including that shown in S. Lindee et al. U.S. Pat. No. 4,428,263, have sliced one loaf at a time, but could be expanded to slice two or more loaves simultaneously. None of the prior high speed slicing machines have had slicing stations with the versatility needed to slice two or more food loaves of the many different sizes and shapes referred to above with just one knife blade. Moreover the previously known slicing stations have had problems with closing off the slicing station during machine clean up, sharpening of the knife blade, and unwanted intrusion of a food loaf into the slicing station at the wrong time.

SUMMARY OF THE INVENTION

It is a principal object of the present invention to provide a new and improved slicing station for a versatile high speed slicing machine, a slicing station capable of slicing one, two, or more food loaves with a single cyclically driven knife blade.

Another object of the invention is to provide a new and improved slicing station for a versatile high speed slicing machine, which slicing station inherently protects itself against entry of hot water or water vapor during cleanup of the slicing machine.

A further object of the invention is to provide a new and improved slicing station for a versatile high speed slicing machine that has a "home" position to facilitate clean up, blade sharpening, and other functions.

These and other objects of the invention are realizable with the present invention as described more fully hereinafter.

Accordingly, the invention relates to a slicing station for a high speed food loaf slicing machine including food loaf support means defining a food loaf path, food loaf feed means for feeding a food loaf along the food loaf path toward a slicing station, and receiving means for collecting and removing groups of food loaf slices cut from the food loaf in the slicing station. The slicing station comprises a knife blade, movable along a predetermined cutting path through a slicing range intersecting the end of a food loaf on the food loaf path. A shear edge member guides the end of a food loaf into the cutting path of the knife blade. There are shear edge mounting means that mount the shear edge member for movement in a predetermined direction toward and away from the knife edge cutting path.

BRIEF DESCRIPTION OF THE DRAWINGS

In the Drawings:

FIGS. 7A and 7B jointly comprise a flow chart for a computer control used in the slicing machine of FIGS. 1–6;

FIG. 15 is a schematic sectional plan view of a portion of a slicing station constructed in accordance with the invention;

FIGS. 16 and 17 are detail section views of the part of the slicing station of FIG. 15 enclosed in the circle marked FIG. 16 iin FIG. 15;

FIG. 18 is a detail view that illustrates a honing device for use in the slicing station of the invention;

FIG. 18A is a simplified schematic illustration of an energizing circuit for the slicing station drives;

FIG. 19 is a detail view, on an enlarged scale, of a part of the honing device shown in FIG. 18.

DESCRIPTION OF THE PREFERRED EMBODIMENTS

A. The Basic Slicing Machine, FIGS. 1–6.

Figure 1:
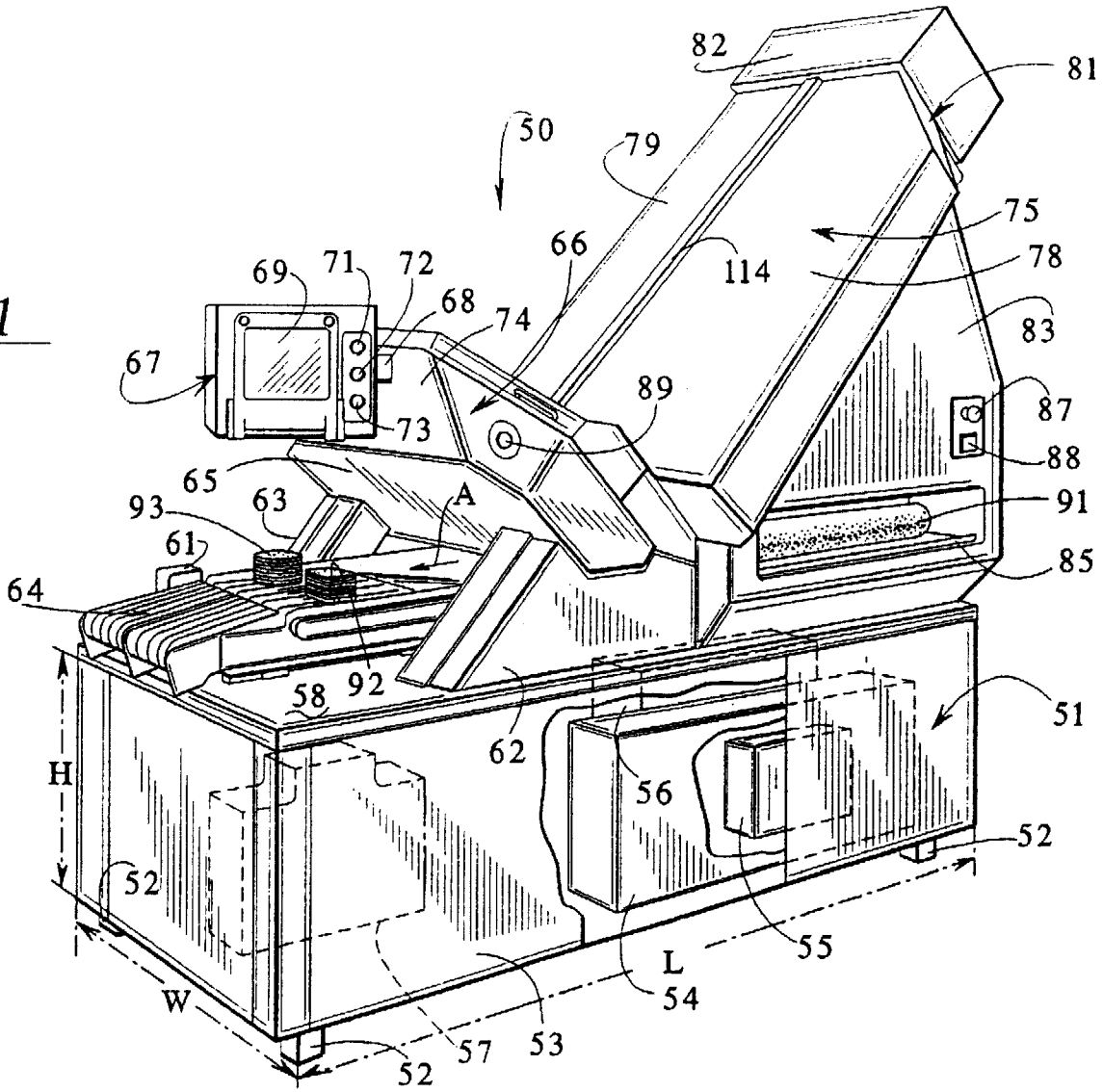
FIG. 1 is a perspective view of a versatile food loaf slicing machine utilizing a slicing station comprising a preferred embodiment of the invention, with portions of the covers on the machine base cut away to show typical power supply and computer enclosures.

FIG. 1 illustrates a food loaf slicing machine 50 that incorporates a slicing station constructed in accordance with a preferred embodiment of the present invention. Slicing machine 50 comprises a base 51 which, in a typical machine, may have an overall height H of approximately 32 inches (81 cm), an overall length L of about 103 inches (262 cm), and a width W of approximately 41 inches (104 cm). Base 51 is mounted upon four fixed pedestals or feet 52 (three of the feet 52 appear in FIG. 1) and has a housing or enclosure 53 surmounted by a top 58. Base 51 typically affords an enclosure for a computer 54, a low voltage supply 55, a high voltage supply 56, and a scale mechanism 57. Base enclosure 53 may also include a pneumatic supply or a hydraulic supply, or both (not shown).

Slicing machine 50, as seen in FIG. 1, includes a conveyor drive 61 utilized to drive an output conveyor/classifier system 64. There is a front side guard 62 extending upwardly from the top 58 of base 51 at the near side of the slicing machine 50 as illustrated in FIG. 1. A similar front side guard 63 appears at the opposite side of machine 50. The two side guards 62 and 63 extend upwardly from base top 58 at an angle of approximately 45° and terminate at the bottom 65 of a slicing station 66; member 65 constitutes a part of the housing for slicing station 66. There is a conveyor/classifier guard (not shown) between side guards 62 and 63, below the bottom 65 of slicing station 66.

The slicing machine 50 of FIG. 1 further includes a computer display touch screen 69 in a cabinet 67 that is pivotally mounted on and supported by a support 68. Support 68 is affixed to and projects outwardly from a member 74 that constitutes a front part of the housing of slicing station 66. Cabinet 67 and its computer display touch screen 69 are pivotally mounted so that screen 69 can face either side of slicing machine 50, allowing machine 50 to be operated from either side. Cabinet 67 also serves as a support for a cycle start switch 71, a cycle stop switch 72, and a loaf feed on-off switch 73. Switches 71–73 and display/touch screen 69 are electrically connected to computer 54 in base 51.

The upper right-hand portion of the versatile slicing machine 50, as seen in FIG. 1, comprises a loaf feed mechanism 75 which, in machine 50, includes a manual feed on the far side of the machine and an automated feed on the near side of the machine. Loaf feed mechanism 75 has an enclosure that includes a far side manual loaf loading door 79 and a near side automatic loaf loading door 78. Slicing machine 50 is equipped for automated loading of loaves from the near side, as seen in FIG. 1, and manual loading of food loaves on the far side of the machine. Automated loaf loading may be provided on either or both sides of the machine; the same holds true for manual loaf loading.

Slicing machine 50, FIG. 1, further includes a pivotable upper back frame 81 and an upper back housing 82. Back frame 81 supports the upper ends of many of the components of loaf feed mechanism 75. A loaf feed guard 83 protects the near side of the loaf feed mechanism 75 and shields mechanism 75 from a machine operator. There may be a similar guard on the opposite side of the machine. There is a loaf lift tray 85 employed to load one or more food loaves into mechanism 75. A fixed loaf storage tray, used for manual loaf loading, is located on the opposite side of machine 50 but is not visible in FIG. 1.

An emergency stop switch 87 for interrupting all operations of slicing machine 50 is mounted on the near side of loaf feed guard 83. There may be a similar emergency stop switch on the opposite side of the machine. A loaf lift switch 88 for initiating automated loading of a loaf from tray 85 into mechanism 75 is located immediately below switch 87. An emergency stop switch 89 is mounted on slicing station 66 on the near side of machine 50, and there is a similar switch (not shown) on the opposite side of the slicing station. Switches 87, 88, and 89, and any counterparts on the opposite (far) side of slicing machine 50, are all electrically connected to the low voltage controls in enclosure 55.

As shown in FIG. 1, slicing machine 50 is ready for operation. There is a food loaf 91 on tray 85, waiting to be loaded into loaf feed mechanism 75 on the near side of machine 50. Two or even three food loaves may be stored on tray 85, depending on the loaf size. Machine 50 produces a series of stacks 92 of food loaf slices that are fed outwardly of the machine, in the direction of the arrow A, by conveyor classifier system 64. Machine 50 produces a series of stacks 93 of food loaf slices that also move outwardly of the machine on its output conveyor system 64 in the direction of arrow A. Stack 92 is shown as comprising slices from a rectangular loaf, and stack 93 is made up of slices from a round loaf. Usually, both of the slice stacks 92 and 93 would be either round or rectangular. Stacks 92 and 93 may have different heights, or slice counts, and hence different weights; as shown they contain the same number of food loaf slices in each stack, but that condition can be changed. Both groups of slices can be overlapping, "shingled" groups of slices instead of having the illustrated stacked configuration. Groups 92 and 93 are the same in one respect; both are stacks or shingle groups. Three or more loaves can be sliced simultaneously; slicing of two loaves is more common.

Figure 2:
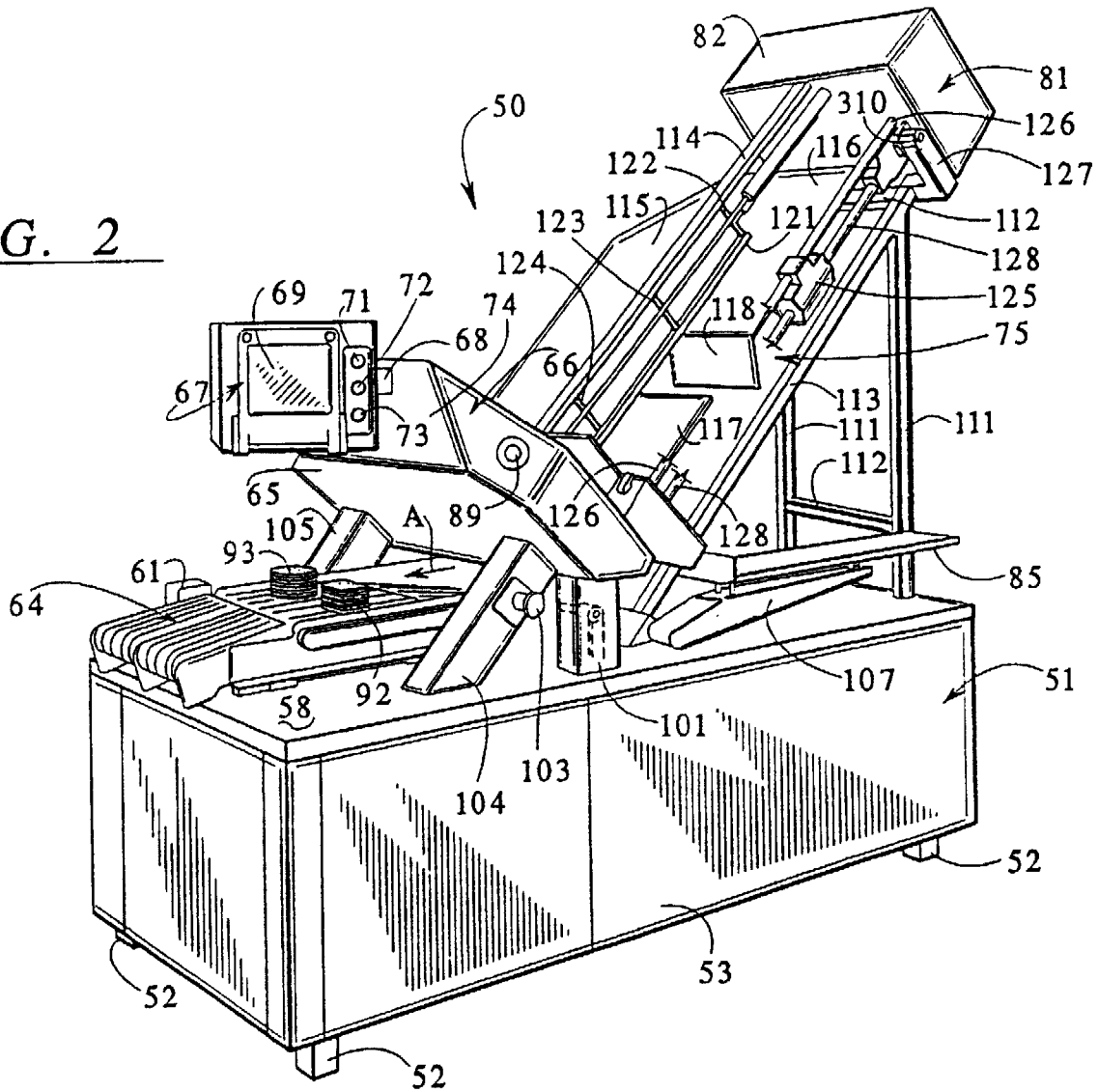
FIG. 2 is a perspective view, like FIG. 1, with some guards and covers for the loaf feed mechanism removed and some operating components of the loaf feed mechanism shown in simplified form.

FIG. 2 illustrates the versatile slicing machine 50 of FIG. 1 with a number of the covers omitted to reveal operating components of the automated loaf feed mechanism 75 on the near side of the machine. As shown in FIG. 2, there is a receiving conveyor drive 101 located on the near side of slicing machine 50. One part of the drive for slicing station 66 is enclosed within a support enclosure 104 on the near side of machine 50. A manual slicing station rotation knob 103 is mounted on and projects into enclosure 104 for mechanical connection to the slicing station drive. At the opposite side of slicing machine 50 there is an enclosure 105 for a knife drive. Slicing station drive enclosure 104 and knife drive enclosure 105 extend upwardly from table top 58 at an angle, preferably approximately 45°, corresponding to the angular alignment of mechanism 75. There is a manual knife rotation knob (not shown) on the far side of machine 50, corresponding to knob 103.

A loaf tray pivot mechanism 107 is located above top 58 of base 51 on the near side of slicing machine 50. Mechanism 107 is connected to and operates the automatic loaf lift tray 85.

Slicing machine 50 includes a fixed frame pivotally supporting the automated feed mechanism 75 for feeding food loaves into slicing head 66. In the construction shown in FIG. 2, this fixed frame includes a pair of vertical frame members 111 affixed to base 51 and interconnected by two horizontal frame members 112 and joined to two angle frame members 113 (only one shows in FIG. 2). Frame members 111–113 are all located above the top 58 of machine base 51. The loaf feed mechanism 75 in slicing machine 50 also includes a frame member 114 that extends from the upper back frame 81 downwardly, generally parallel to frame members 113, toward slicing head 66. The upper back frame 81 is mounted on pivot pins between the upper ends of two fixed frame members 127; only one member 127 appears in FIG. 2. All of the operating elements of the automated food loaf feed mechanism (see FIG. 6) are mounted on the back frame and are pivotally movable (through a small angle) relative to the fixed frame 111–113.

A manual feed tray 115 is shown at the far side of slicing machine 50 as illustrated in FIG. 2.

Mechanism 75 includes three loaf support components, two of which are preferably of unitary one-piece construction. At the top of slicing machine 50, as seen in FIG. 2, there is an upper loaf support tray 116 that has its upper surface aligned with the top surface of a lower loaf support tray 117. Supports 116 and 117 are preferably one piece, being joined by side members omitted in FIG. 2 to avoid overcrowding. The gap between loaf supports 116 and 117 is normally filled by a door 118; thus, members 116–118 normally afford a continuous loaf support surface that is the bottom for the two loaf paths in slicing machine 50. In FIG. 2, however, door 118 is shown in its open, loaf end discharge position. A textured upper surface is preferred for support members 116–118 to improve sliding movement of a food loaf along those support members toward slicing station 66.

The loaf feed mechanism 75 of slicing machine 50, FIG. 2, further includes a central barrier or divider 121, used to align two food loaves on supports 116–118. This central barrier/divider 121 is suspended from frame member 114 by a plurality of pivotal supports 122, 123 and 124. During operation of slicing machine 50 divider 121 is elevated from the position shown in FIG. 2 to permit loading of one or more food loaves onto the supports 116–118. Barrier 121 is also elevated during loaf slicing so that it will not interfere with other components of mechanism 75.

The part of food loaf feed mechanism 75 shown in FIG. 2 also includes a carriage 125 that is mounted upon a rotatable shaft 126 and a fixed shaft 128; both shafts extend parallel to the loaf support 116–118 throughout the length of food loaf feed mechanism 75. That is, carriage 125 moves along shafts 126 and 128 along a path approximately parallel to support members 113. There is a like carriage, carriage shafts, and carriage drive on the far side of slicing machine 50. See FIG. 6.

Figure 3:
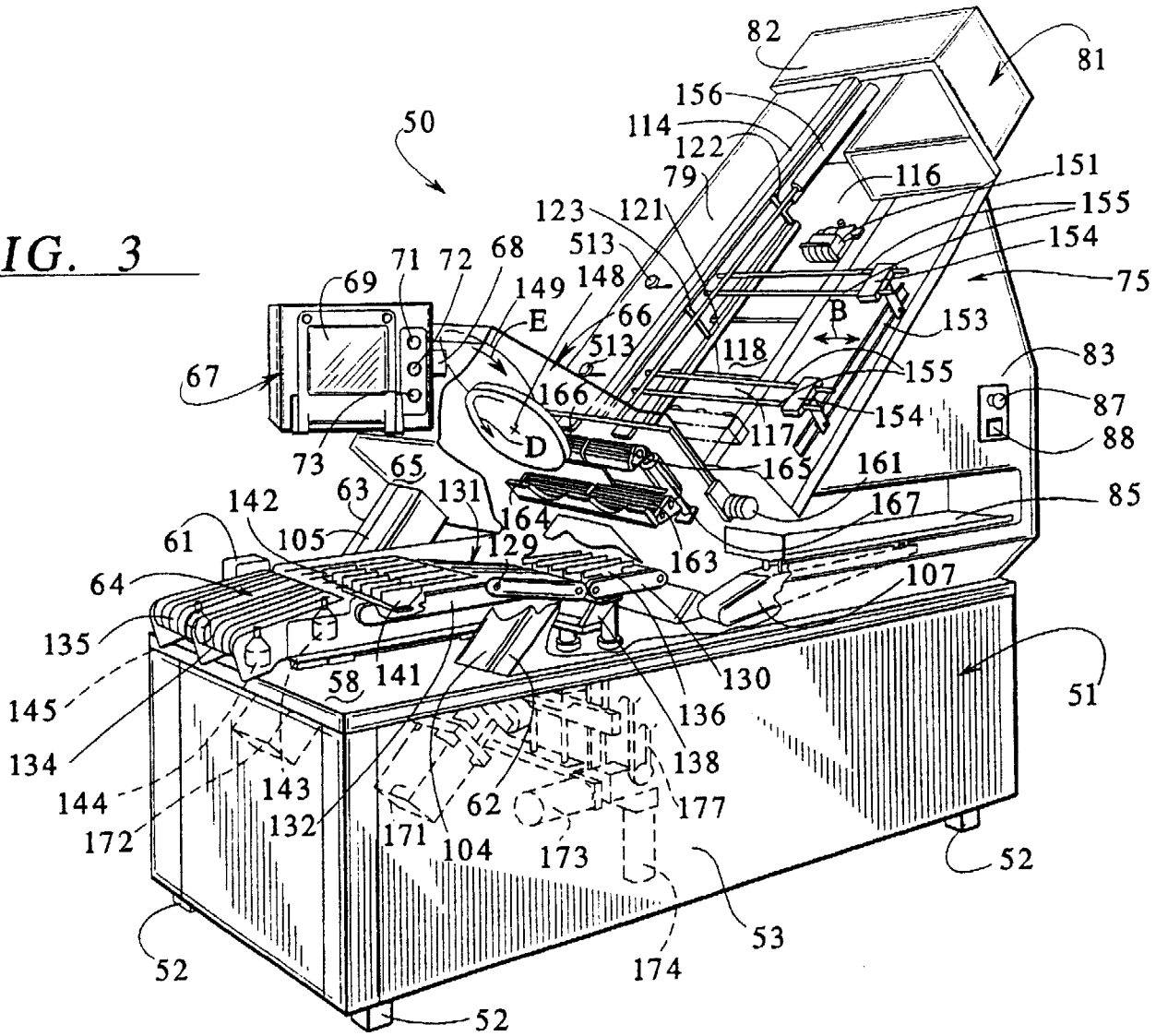
FIG. 3 is a perspective view, like FIGS. 1 and 2, with other guards and covers cut away to show further operating components of the slicing machine, including the slicing station, with some components illustrated in simplified form.

FIG. 3 illustrates the same versatile slicing machine 50 that is shown in FIGS. 1 and 2 in a conceptual view showing additional components for loaf feed mechanism 75 and other parts of the slicing machine. Thus, FIG. 3 also illustrates the general arrangement of operating components within one construction for slicing head 66, one construction that may be used for conveyor/classifier system 64, and the drive motors for parts of slicing machine 50.

Referring first to conveyor/classifier system 64 at the left-hand (output) end of slicing machine 50, in FIG. 3, it is seen that system 64 includes an inner receiving conveyor 130 located immediately below slicing head 66; conveyor 130 is sometimes called a "jump" conveyor. From conveyor 130 groups of food loaf slices, stacked or shingled, are transferred to a deceleration conveyor 131 and then to a weighing or scale conveyor 132. From scale conveyor 132 the groups of food loaf slices on the near side of the machine move on to an outer classifier conveyor 134. On the far side of slicing machine 50 the sequence is the same, but that side of system 64 ends with a second outer classifier conveyor 135 located next to conveyor 134; see FIG. 5.

Slicing machine 50, FIG. 3, may further include a vertically movable stacking grid 136 comprising a plurality of stack members joined together and interleaved one-for-one with the moving elements of the inner stack/receive conveyor 130. Stacking grid 136 can be lowered and raised by a stack lift mechanism 138, as shown in FIG. 3. Alternatively, food loaf slices may be grouped in shingled or in stacked relationship directly on the receiver conveyor 130, with a series of stacking pins 137 replacing grid 136 (see FIG. 5). When this alternative is employed, lift mechanism 138 is preferably connected directly to and is used for vertical positioning of receiver conveyor 130.

Slicing machine 50 further comprises a scale or weighing grid including a first plurality of scale grid elements 141 and a second group of scale grid elements 142, both interleaved one-for-one with the moving belts or like members of scale conveyor 132. Scale grids 141 and 142 are a part of scale mechanism 57 (see FIG. 1). A scale lift mechanism 143 is provided for and is mechanically connected to scale conveyor 132. There is no weighing mechanism associated with either of the two output or classifier conveyors 134 and 135. However, there is a classifier conveyor lift mechanism 144 connected to the near side classifier conveyor 134. A similar lift device 145 is provided for the other output classifier conveyor 135. Lift devices 144 and 145 are employed to pivot conveyors 134 and 135, respectively, from their illustrated positions to elevated "reject" positions, depending on the results of the weighing operations in machine 50 ahead of conveyors 134 and 135. See also FIG. 5.

In FIG. 3, slicing station 66 is shown to include a rotating spindle or head 148. Head 148 is driven to rotate counterclockwise, as indicated by arrow D; the range of head speeds is quite large and may typically be from ten to seven hundred fifty rpm. A round knife blade 149 is shown rotatably mounted at a non-centralized location on head 148. Knife blade 149 is driven separately from head 148, rotating clockwise in the direction of arrow E. The range of knife blade speeds again is quite large and may typically be from ten to four thousand six hundred rpm. Blade 149 thus performs an orbital motion while it rotates. Other slicing head constructions may be used in machine 50, so long as the cutting edge of knife blade 149 moves cyclically along a predetermined cutting path to slice food loaves in station 66 in each cycle of operation.

As shown in FIG. 3, loaf feed mechanism 75 includes a near-side clamp or gripper mechanism 151. There is a similar gripper mechanism (not shown) at the far side of slicing machine 50. Gripper 151 is connected to and driven by carriage 125 (FIG. 2).

Loaf feed mechanism 75 further comprises a near-side sweep member 153 suspended from two sweep carriages 154 which in turn are each mounted upon a pair of sweep support rods 155. Sweep mechanism 153–155 is employed on the near side of machine 50. A corresponding sweep mechanism (not shown) may be located on the far side of a slicing machine equipped for automated loaf loading from both sides. Sweep carriages 154 are driven along rods 155 by belts, not shown in FIG. 3, as indicated by arrows B. Rods 155 are connected to a rotatable sweep actuation shaft 156 for actuation thereby; see FIG. 6.

Slicing machine 50 is intended to accommodate food loaves of widely varying sizes; it can even be used as a bacon slicer. This makes it necessary to afford a height adjustment for the food loaves as they move from loaf feed mechanism 75 into slicing head 66. In FIG. 3, this height adjustment is generally indicated at 161.

Slicing machine 50 further comprises two pair of short conveyors for advancing food loaves from loaf feed mechanism 75 into slicing head 66. The short conveyors are actually a part of loaf feed mechanism 75. FIG. 3 shows two short lower loaf feed conveyors 163 and 164 on the near and far sides of slicing machine 50, respectively. The short lower conveyors 163 and 164 are located immediately below two short upper feed conveyors 165 and 166, respectively. As used in describing conveyors 163–166, the term "short" refers to the length of the conveyors parallel to the food loaf paths along support 116–118, not to the conveyor lengths transverse to those paths. The upper conveyor 165 is vertically displaceable so that the spacing between conveyors 163 and 165 can be varied to accommodate food loaves of varying height. This adjustment is provided by an actuator 167. A similar actuator is located on the far side of machine 50 to adjust the height of the other upper short conveyor 166; the second lift actuator cannot be seen in FIG. 3.

Some of the drive motors for the operating mechanisms in slicing machine 50 are shown in FIG. 3. The drive motor for the head or spindle 148 in slicing station 66 is an A.C. variable speed servo motor 171 mounted in the machine base 51. A similar servo motor 172 drives the knife blade 149. The stacker lift 138 is driven by a stacker lift motor 173, again preferably a variable speed A.C. servo motor. On the near side of machine 50 the loaf feed drive mechanism comprising the carriage 125 for gripper 151 and the short loaf feed conveyors 163 and 165 is driven by a servo motor 174. A like motor 175 on the far side of machine 50 (not shown in FIG. 3) affords an independent drive for the gripper and the "short" loaf feed conveyors 164 and 166 on that side of the slicing machine; see FIG. 4.

Figure 4:
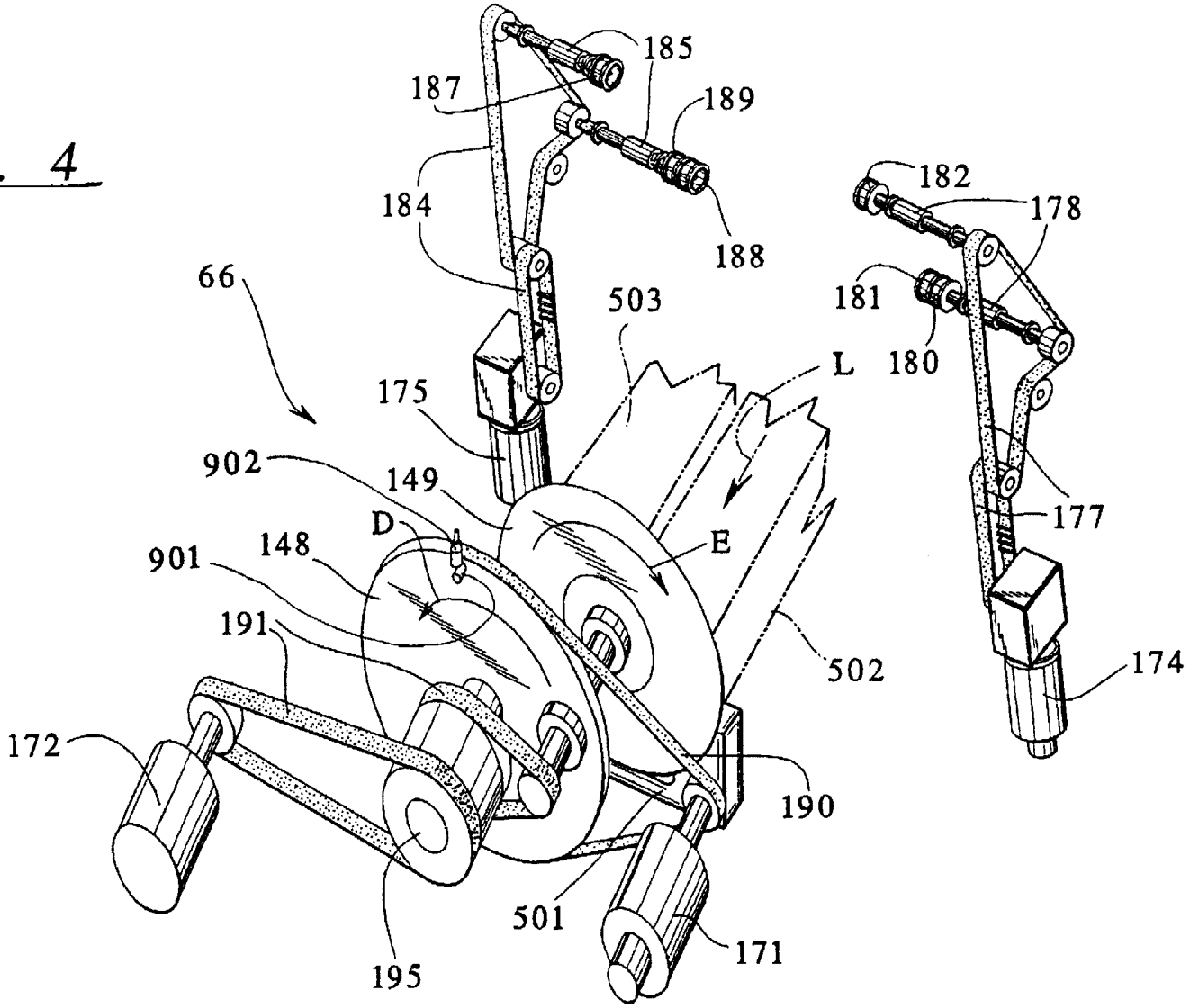
FIGS. 4, 5 and 6 are schematic, simplified illustrations of some operating components of the slicing machine of FIGS. 1–3.

FIG. 4 affords an extended, simplified illustration of the slicing station 66 of the slicing machine of FIGS. 1–3, along with the loaf feed drives. In FIG. 4, servo motor 174 is shown connected, as by a series of timing belts 177 and a pair of universal-joint drive connectors 178, in driving relation to loaf feed conveyor drive pulleys 181 and 182 and to another loaf feed belt drive pulley 180. Pulley 181 is the drive pulley for the near-side lower "short" loaf feed conveyor 163; pulley 182 is the drive pulley for the near-side upper "short" loaf feed conveyor 165 (FIG. 3). Pulley 180 is the drive pulley for the belt 334 (FIG. 6) that drives gripper carriage 125. All of the loaf feed drive pulleys 180–182 (FIG. 4) have the same peripheral speed. Variation of the operating speed of servo motor 174 serves to vary the speed at which one food loaf (e.g., loaf 502) is advanced into slicing station 66.

On the far side of FIG. 4 there is another servo motor 175 that, through a series of belts 184 and a pair of universal-joint drive connectors 185, drives the drive pulleys 187 and 188 for the far side "short" loaf feed conveyors 164 and 166; see FIG. 3. Motor 175 also drives a drive pulley 189 for a gripper carriage drive belt (not shown) that is a part of the food loaf feed on the far side of machine 50. The peripheral speeds for the loaf food drive pulleys 187–189 are all the same. The two servo motors 174 and 175 are adjustable in speed, independently of each other. Thus, either motor may have its speed regulated to adjust slice thickness for one loaf (e.g. loaf 503) independently of the other (e.g. loaf 502).

FIG. 4 schematically illustrates the drive connection from servo motor 171 to the head or spindle 148 in slicing station 66, through a belt 190; head 148 rotates counterclockwise as indicated by arrow D. Servo motor 172, on the other hand, rotates knife blade 149 clockwise (arrow E) through a drive connection afforded by two timing belts 191. Orbital movement of knife blade 149 depends upon the rotational speed of servo motor 171 and the speed of rotational movement of the blade is controlled by motor 172. Each can be varied independently of the other. A marker 901 is mounted on spindle 148; a sensor 902 is positioned to detect the presence of marker 901. Marker 901 may be a permanent magnet. Devices 901 and 902, when aligned, determine that spindle 148 is in a predetermined "home" position; when head 148 is in its "home" position, as shown in FIG. 4, blade 149 is also located at "home". Marker 901 may comprise a small permanent magnet and sensor 902 can be an electromagnetic sensor responsive to magnetic flux.

Figure 5:
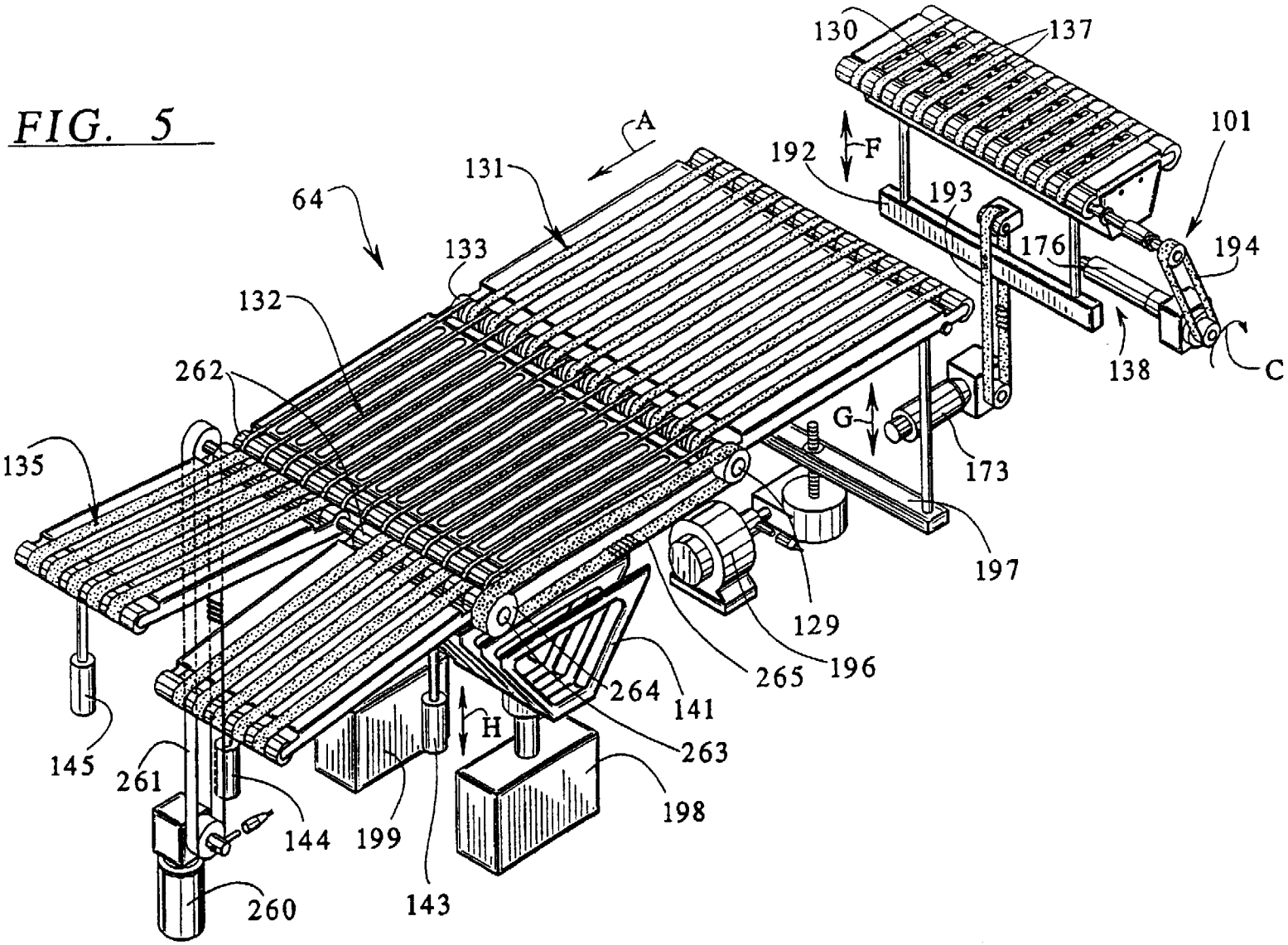

FIG. 5 shows the manner in which lift motor 173 is connected to receiving conveyor 130 by lift mechanism 138; the drive connection is afforded by connection of a yoke 192 to a timing belt 193 driven by servo motor 173. Thus, motor 173 acts to lift or lower receiver conveyor 130; these actions (arrows F) are carried out cyclically for each group of slices cut from a loaf or loaves 502 and 503 fed into slicing station 66 in the direction of arrow L, FIG. 4. Conveyor 130 also requires a drive motor, shown in FIG. 5 as the servo motor 176, driving conveyor 130 through a belt 194 in drive 101. During slicing of a pair of loaves motor 176 may rotate slowly in the direction of arrow C (clockwise as seen in FIG. 5) while motor 173 and mechanism 138 lower conveyor 130 to obtain precise vertical stacks for each group of slices from each loaf. If shingled groups are desired, motor 176 rotates slowly counterclockwise (opposite arrow C) while the loaves are sliced. When the slice groups are complete, motor 176 drives conveyor 130 and stacker pins 137 rapidly counter-clockwise to shift the group of slices, stacked or shingled as the case may be, onto deceleration conveyor 131. Thereafter, motor 173 again elevates the receiver conveyor 130 rapidly to be in an elevated position, ready to receive two new groups of food loaf slices.

As shown in FIG. 5, conveyors 131 and 132 share a common shaft 129, also seen in FIG. 3; a pulley 133 is mounted on shaft 129. Shaft 129 and pulley 133 are at a fixed height. The end of conveyor 131 opposite pulley 133 is adjustable upwardly and downwardly to the level necessary to receive groups of food loaf slices from conveyor 130; see arrows G in FIG. 5. The vertical movements of conveyor 131 are provided by mounting the inner end of conveyor 131 (right hand end as seen in FIG. 5) on a yoke 197 that is moved upwardly or downwardly by a motor 196. Motor 196 may comprise a pneumatic device, but a hydraulic device or an electrical motor could be used. The height of the end of deceleration conveyor 131 connected to yoke 197 does not change during slicing.

The outer (left-hand) end of scale conveyor 132 is dropped a short distance and subsequently elevated to the position illustrated in FIG. 5 each time a group of food loaf slices (usually two groups side-by-side) traverses the scale conveyor; see arrows H. This brief vertical movement of the outer end of conveyor 132 is effected by the scale lift mechanism 143. A pneumatic cylinder is preferred for lift 143; a hydraulic cylinder or an electrical linear motor could be used. When the outer (left-hand) end of conveyor 132 moves down, any group or groups of slices on conveyor 132 are deposited momentarily on scale grids 141 and 142 and weighed by load cells 198 and 199 respectively (grids 147 are not shown in FIG. 5). Mechanism 143 promptly moves scale conveyor 132 back up to again lift and carry the slice groups onward to classifier conveyors 134 and 135. Each group of food loaf slices that weighs in within a preset tolerance range is discharged downwardly with its classifier conveyor held down in the "in tolerance" position shown for classifier conveyor 134 in FIG. 5. The weight tolerance range may be different for slice groups on the near and far sides of scale conveyor 132. Each group of slices that does not come within the selected weight range is diverted upwardly by its classifier conveyor, held elevated in the "reject" position shown for conveyor 135 in FIG. 5. Vertical movements of the outer ends of classifier conveyors 134 and 135 are effected by linear lift mechanisms 144 and 145 for conveyors 134 and 135 respectively. Pneumatic cylinders are preferred for devices 144 and 145, but other mechanisms could be employed.

Each time scale conveyor 132 is moved downwardly (arrows H) by its lift mechanism 143, so that a group of food loaf slices on the scale conveyor is deposited on scale grid 141 on the near side of the slicing machine, load cell 198 weights that group of slices. It is this weighing operation that determines whether the classifier conveyor 134 is maintained in the lower "in tolerance" position shown in FIG. 5 or is moved up to the "reject" position shown for conveyor 135 in FIG. 5. Load cell 199 performs the same basic weighing operation for each group of food loaf slices on the far side of the machine. Thus, weight signals from load cells 198 and 199 are used to actuate cylinders 144 and 145 to elevate conveyors 134 and 135, respectively, to their "reject" alignments when food loaf slice groups are not in the preset weight ranges established for the loaves being sliced. Conversely, if a slice group weight is within the weight tolerance range, when weighed by one of the load cells 198 and 199, the signal from the applicable load cell is used to actuate the associated cylinder 144 or 145 to move the related classifier conveyor 134 or 135 down to its "in tolerance" position or to maintain that classifier conveyor down in the "in tolerance" position.

Conveyors 131, 132, 134 and 135 all are driven at the same preselected speed, in the direction of arrow A, FIG. 5. That speed is adjusted to fit requirements imposed by the speed of the cutting blade in station 66, FIG. 4. A conveyor drive motor 260 (FIG. 5) is connected to a timing belt 261 that drives a spindle/pulley 262 serving both classifier conveyors 134 and 135. The drive spindle/pulley 262 is mounted on a shaft 263; the end of shaft 263 opposite belt 261 carries a drive pulley 264 in mesh with a timing belt 265 used to rotate shaft 129 and the spindle 133 that drives both of the belt conveyors 131 and 132.

Figure 6:
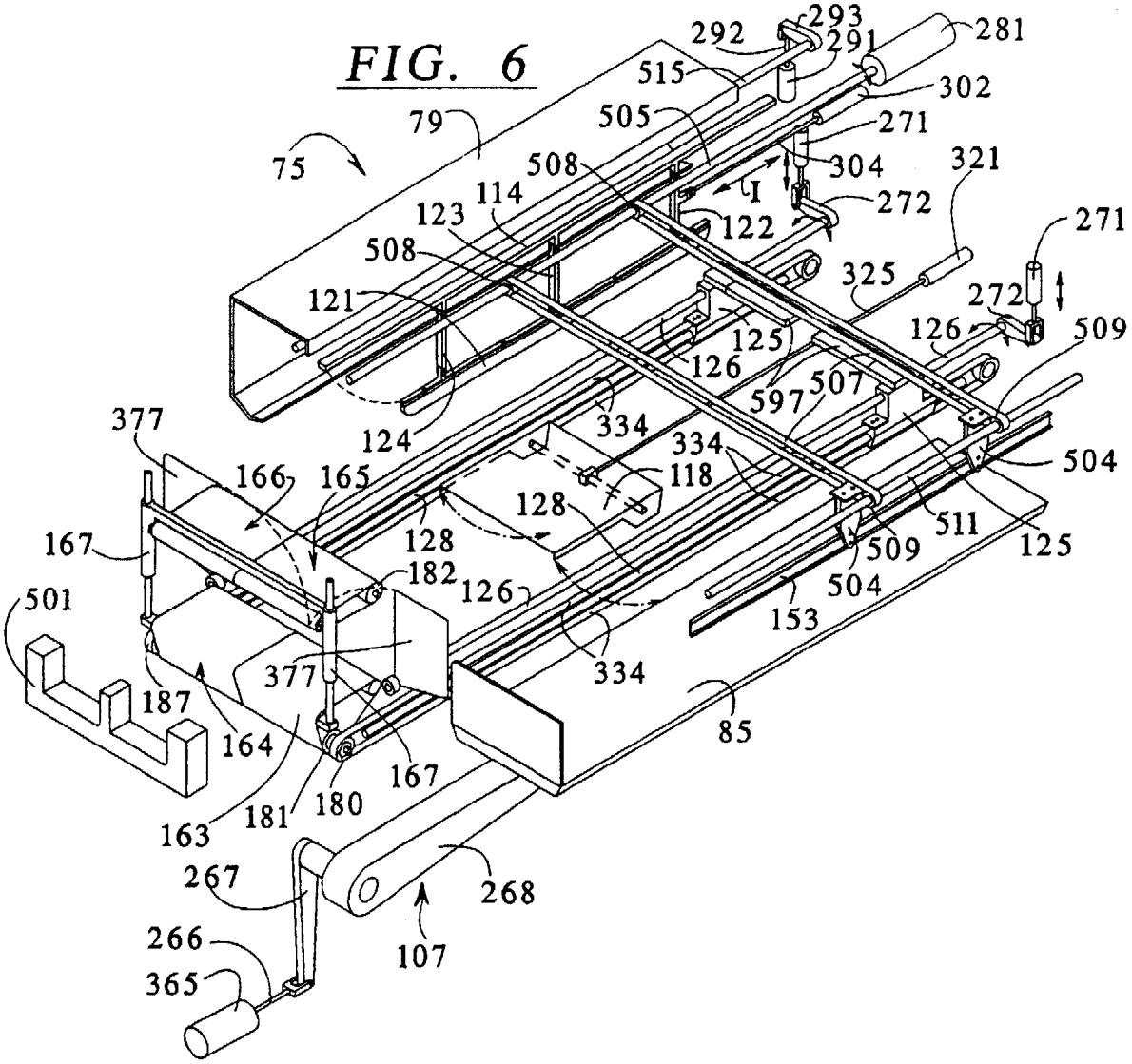

FIG. 6 affords a simplified schematic illustration of most of the loaf loading and loaf feed mechanisms in the slicing machine 50. Starting at the left-hand side of FIG. 6, there is a loaf lift cylinder 365 having an actuating rod 266 connected to a crank 267 that in turn drives a loaf lift lever 268. These members are all part of the loaf lift mechanism 107 that lifts storage tray 85 from its storage position (FIGS. 1–3) to a level even with the support on which food loaves rest during slicing. The loaf lift mechanism is actuated only during loaf loading; during most of a loaf feeding/slicing operation, cylinder 365 is not actuated and tray 85 remains in its storage position.

FIG. 6 shows the "short" conveyors 163–166, with the two upper "short" conveyors 165 and 166 mounted on the housings of cylinders 167. Cylinders 167 have fixed shafts; air applied under pressure to the cylinders tends to drive their housings, and hence conveyors 165 and 166, down toward the lower conveyors 163 and 164. Downward movement of the upper conveyors is blocked by a shear edge member 501 that is specific to the size of loaves being sliced, as explained hereinafter, so that each pair of the "short" conveyors engages opposite sides (top and bottom) of a food loaf being sliced. The drive spindles 181, 182, and 187 for conveyors 163, 165 and 164 also appear in FIG. 6; their drives are shown in FIG. 4.

Drive pulley 180, shown in FIG. 4, also appears in FIG. 6. It is in meshing engagement with a near side timing belt 334 that extends the full length of the loaf feed mechanism 75. Belt 334 is connected to gripper carriage 125 on the near side of the slicing machine and is used to drive the carriage toward the slicing station. There is a like gripper carriage 125 driven by another long timing belt 334 on the far-side of the machine. Two parallel shafts 126 and 128 guide movements of each of the carriages 125. Shafts 128 are stationary but each of the shafts 126 can be rotated by means of a loaf door cylinder 271 and a connecting crank 272.

Returning to the left-hand side of FIG. 6, it is seen that there are two loaf doors 377, one on each side of the feed mechanism 75, immediately to the right of conveyors 163–166. The near side loaf door 377 is mounted on shaft 126 so that it can be rotated to close off access of a food loaf into the space between conveyors 163 and 165. Similarly, the far side loaf door 377 is mounted on the other shaft 126 and can be rotated to close off access of a food loaf into the space between conveyors 164 and 166. Each food loaf door is pivotally movable between a blocking position across one of the food loaf paths and an inactive position clear of that path. Thus, doors 377 block entry of food loaves into slicing station 66 when such entry is undesirable.

FIG. 6 shows barrier divider 121 suspended from auxiliary frame member 114 by three pivotal hangers 122–124. The hanger 122 at the right-hand end of barrier 121, as seen in FIG. 6, is connected by a shaft 304 to an air cylinder or other linear actuator 302. Linear actuator 302 is used to lift barrier 121, pivotally, to a point clear of any food loaves in the loaf feed mechanism.

On the near side of the versatile slicing machine 50, in feed mechanism 75, there is an elongated sweep 153; see the lower right-hand portion of FIG. 6. Sweep 153 is suspended from two hangers 504, each connected to a drive belt 507. There are structural members, not shown in FIG. 6, that afford further support for the hangers 504; see FIG. 3. Belts 507 are timing belts, each engaging a drive pulley 508 and an idler pulley 509. The idlers 509 are mounted on a shaft 511. The drive pulleys 508 are each affixed to a shaft 505 rotated by a loaf sweep motor 281.

FIG. 6 also shows the loaf feed door 118 that is a central part of the loaf support for the slicing machine. In FIG. 6 door 118 is in its normal elevated position, the position the door occupies when slicing is going forward. Door 118 is connected by a long rod 325 to a linear actuator 321 that opens the door to allow discharge of an unsliced butt end of a loaf; see FIGS. 2 and 3.

Some of the manual loaf loading components of mechanism 75 do not appear in FIG. 5; they are masked by the manual loaf door 79 which is mounted on a shaft 515. Shaft 515 is rotated by a manual door cylinder 291 connected to the shaft by its operating rod 292 and a crank 293.

B. The Computer Flow Chart, FIGS. 7A and 7B.

Slicing machine 50 (FIGS. 1–3) is fully computer controlled. Accordingly, basic operation can be described in conjunction with a flow chart indicative of the control functions carried out by the computer program. FIGS. 7A and 7B afford the requisite flow chart; FIG. 7B follows FIG. 7A. The basic preferred driver software is TOUCH BASE driver software, licensed by Touch Base, Ltd. through Computer Dynamics of Greer, South Carolina; this driver software package allows operation of the touch screen functions used in slicing machine 50. If this driver software does not load on start up there is a serious problem with computer control.

At the outset, when slicing machine 50 is first placed in operation, power to the machine is turned on, as by actuation of an appropriate input power supply switch. This input power switch is not shown in the drawings; the power supply switch may be located in or on base 51 of machine 50. Calibration of the touch screen may be required on start up; if so the operator of the slicing machine initiates calibration by actuating switches 72 and 73 (FIGS. 1–3) simultaneously. If no calibration is needed, the first step in computer control of machine 50, in the initial part of the flow chart (FIG. 7A), is an initial start 201, also effected by the machine operator. This may be accomplished with the power supply switch referred to above, or an additional switch may be interposed in the circuit to energize computer 54 through the low voltage power supply 55 and the display/touch screen 69 (FIG. 1). In the next step 202 of the flow chart, a check is made to determine if the driver software is loaded; if not, a warning reset is supplied to step 201.

Once the driver software is loaded for step 202, and screen 69 has been energized, the program recorded in computer 54 (FIG. 1) performs a sequence of initial functions, indicated by step 203 in FIG. 7A. These initial functions may include initializing interrupt of vectors, graphics drives, determination of spindle tracking hours, establishment of product codes for defaults, and a check of a battery energized backup record memory (RAM). The computer program also sets the appropriate code to match the product to be sliced by the machine, selects several action boards previously set up in the computer, makes a determination of motion control interrupt functions, establishes raw data for scale arrays related to the food loaf products and the slicing operation, and selects previously recorded graphics pertaining to a wide variety of different products so that the graphics subsequently displayed on screen 69 match the product being processed. In addition, the computer program, in the course of the initial functions step 203 (FIG. 7A), sets the maximum knife speed ratio relative to the speed of slicing head 66 required for the desired slicing operation. For any of these initial functions, some input from the machine operator may be necessary; most inputs are effected by operator touch on screen 69 (FIGS. 1–3).

At this juncture, the touch/display screen 69 has been energized; the computer program for machine 50, in step 204, FIG. 7A, sets up a title page on the screen pertaining to the slicing and grouping operation or operations to be performed by machine 50. At the same time, or immediately thereafter, the computer program operates (step 205) to start up various power systems in machine 50. These functions may include initialization of an air pressure system or a hydraulic pressure system in machine 50, or both, depending on the requirements of operating components in the machine. Pneumatic actuation is usually preferred. A motor control power circuit, included in the high voltage power supply 56 (FIG. 1), is energized so that electrical motors (mostly servos) used to perform various functions in machine 50 have power available. In step 205 the computer program also determines appropriate sample periods for weighing operations and a seam correction for the scales actuated by weighing grids 141 and 142; the sample periods may be the same if machine 50 is to produce just one product from two or more separate loaves. In step 205 the computer program also determines the average slice thickness required for each product from machine 50. Again, the slice thicknesses (and the loaf and knife speeds that determine those thicknesses) may be the same, or they may be different for loaves sliced on the near and far sides of machine 50.

Once the computer program has completed the initializing functions of step 205, FIG. 7A, it starts an idle loop operation as indicated in step 206. This idle loop start step can go forward only if there are appropriate inputs from two flag determinations performed in steps 234 and 237 in FIG. 7B. When machine 50 has been idle, as is assumed, appropriate inputs are available from both of the two steps 234 and 237 in FIG. 7B.

At the beginning of the idle loop operation, step 206 in FIG. 7A, the program for slicing machine 50 tracks the running of calculation of a total time for the anticipated run of the slicing machine by reading start time and stop time and taking the difference; the computer also performs a plurality of other tracking functions, in step 207 (FIG. 7A). Thus, the computer records the total run time and also records the total time for power to be on, which may be somewhat longer. In step 207, the computer program may make a determination of the time period permissible before service of slicing machine 50 is required.

When these operations have been completed in step 207 the computer determines if an emergency stop check can be cleared in the next step 208. What this amounts to is a check to determine whether any of the emergency stop switches 87 and 89 have been actuated. If an emergency stop signal has been recorded, there is a "yes" output at step 209 in the program, resulting in initiation of a subsequent step 211. In step 211 the computer records a fault message, turns off all machine outputs, and stops all machine motors. If there is a "no" output at step 209, indicative of the fact that no emergency stop switch has been actuated, then a step 212 is carried out by the computer to clear any emergency stop message that may be held over from previous operations and to clear all flags from the control system.

In the next program step 213, FIG. 7A, the computer of slicing machine 50 makes a determination as to whether an emergency stop has been set. If this action has occurred, the next step 214 is the performance of a servo check by the computer and a determination of whether the drives for machine 50 are not ready for operation or if there has been a fault due to a thermal overload. In this step 214 the computer also may set a "stop now" flag. If such a flag is set, in the next step 215 the existence of that flag is identified and a further program step 216 is initiated to stop all motion in the slicing machine 50 and to carry out a normal shut down of that machine.

Returning to step 213, the computer may ascertain that no emergency stop has been set. In this circumstance, a step 217 is initiated to check whether all guards and doors have been closed on machine 50 and the motor drives for the slicing machine are ready for operation. In step 217 the computer also makes a determination of whether electrical faults have occurred as a result of vibration or other causes. If no fault is ascertained, an enabling output is produced in the next step 218 and fed back to the servo check of step 214. If a fault is found, the next program step 219 is initiated, setting a fault message, turning all outputs off, and stopping all motors in the slicing machine 50. The output from step 219 is supplied back to the servo check step 214. In FIG. 7A, it will be seen that steps 207–209 and 211–219 are all enclosed in a phantom outline 221, which is referred to again hereinafter in conjunction with a portion 248 of FIG. 7B.

The next step in the flow chart of FIG. 7A is a determination of whether a product removal flag has been set; see step 222. If such a flag has been set, a subsequent program step 223 is initiated. At this juncture, if the operator has held the load feed switch 73 (FIG. 1) actuated for a predetermined minimum period (typically five seconds) then the computer program prepares for product removal. Completion of step 223 or a determination in step 222 that no product removal flag has been set results in initiation of a further step 224, constituting a display of an emergency stop message on display screen 69 (FIG. 1).

Following step 224, in the next step 226 of FIG. 7A the recorded program of slicing machine 50 checks to determine whether a flag has been set to preclude jogging of the conveyor/classifier system 64. If there is an affirmative output from step 226, a subsequent step 227 starts jogging movement of the conveyor system. An output from step 227 or a negative output from step 226 initiates a subsequent step 228, which is a check to determine whether a flag has been set to stop jogging of the conveyor system. If no such flag has been set there is an output to the initial stage 232 of FIG. 7B. If there is an affirmative output from step 228, then an additional step 229 is carried out to stop jogging of the conveyor system 64 (FIG. 1).

FIG. 7B shows the steps for the remainder of the flow chart that began with FIG. 7A. At the beginning of the portion of the flow chart shown in FIG. 7B, there is a program step 232 in which the computer looks to see if there has been a start run and a fault set. If both conditions have occurred while attempting to start a run cycle, there is a YES output from step 232 to the next step 233 and a disabling cycle is initiated for slicing machine 50 by the program prerecorded in its computer. In the course of step 233, if there has been a run flag, so that running of the machine is not permissible, that flag may be cleared. Of course, the stated combination of conditions (lack of a start run or a run fault set) may not be found in step 232, in which case step 233 is by-passed. In either event, there is an enabling input to a further step 234 in the computer program, which again checks for the existence of a run flag. Actually, in step 234 the program is checking to see whether the cycle start switch 73 has been actuated by the operator. If not, there is an output to step 206 in FIG. 7A. If the operator has actuated the run/start control switch, there is an enabling output to the next step 235 in the flow chart.

In step 235 of the flow chart, FIG. 7B, the computer performs a variety of functions. To begin with, it records the time that machine 50 has been out of operation for faults and starts a number of machine subsystems in operation. Thus, in display 69 the computer program causes the display of a homing message. The knife 149 in slicing head 66 (FIG. 3) is brought to a home orientation. The grippers 151 of loaf feed system 75 (see FIG. 3) are also brought to their respective home positions. Other homing operations are performed for the conveyors of conveyor system 64. The computer checks to see if the enclosure doors for loaf feed system 75 are closed, as shown in FIG. 1. Center divider 121 (FIGS. 2 and 3) is raised to its elevated position, high enough to be clear of any loaf that may be moved onto the loaf supports (116–118) of the slicing machine. Grippers 151 are unactuated. The controls of machine 50 are set for automatic or manual loading. The loaf cover is raised, stacking conveyor 130 is elevated, and motion control for the machine is checked to see whether it has been cleared. The anticipated production start time is also recorded in step 235. When all of these operations have been completed, an output to step 236 in the flow chart is effected; machine 50 is now ready to start slicing. It is assumed that there is an appropriate input to program step 236 from the final step of the flow chart, as described below.

In the next step 237 of the program illustrated by the flow chart of FIG. 7B, the computer of machine 50 ascertains whether a flag has been set to permit running operation. This is a requirement imposed upon the machine operator. If it has not been fulfilled, there is a no output from stage 237 to step 206 in the portion of the flow chart illustrated in FIG. 7A, so that machine 50 reverts to its idle mode of operation. However, if the operator has set a run flag to indicate that machine 50 is ready for slicing and that such operation is desired, then there is an output from program step 237 to the next step 241.

It may be desirable to check for profile variations at the beginning and end of each food loaf sliced, in order to track taper of the loaf and made thickness corrections according to loaf profile trends. If profile corrections are to be made, step 241 affords a YES output to the next step 242 to make profile corrections. If there are to be no profile corrections, or if none are required, the next input is to program step 243. At this point, the touch screen 69 is checked to see if the operator has entered instructions by means of a touch; the selected screen image is displayed. In the succeeding step 244 the computer checks to see if gross weight is to be measured. If the answer is YES, a gross weight for the product is determined in step 245. When that weighing step is completed, or if no gross weight is to be determined, the flow chart goes on to a further step 246. In the next step 246 the computer ascertains whether a stop switch has been actuated or a fault has been found by the sensor switches of machine 50, such as sensor switches that determine whether all guards are in place. If, in step 246, it is determined that operation of the slicing machine 50 should not begin, then in the next step 247 all motion within the machine is interrupted and a normal shutdown is carried out. Step 247 is bypassed if there is a negative condition ascertained in step 246. After step 247, the program represented by the flow chart performs functions, in a composite step 248, that correspond in all respects to the functions described above for steps 207–209 and 211–219 in phantom outline 221 of FIG. 7A.

After the composite step 248, FIG. 7B, an input to the next step 252 in the flow chart may result in a determination that the gripper clamps 151 of machine 50 (FIG. 3) need to be retracted, or that they do not need to be retracted. If the gripper clamps must be retracted, then program step 253 comes into play. The clamps are retracted, and the average load time and number of loaves are tracked. On the other hand, step 253 in the program may be bypassed by a negative output from step 252. In either case, there is an enabling input to program step 254, where it is ascertained whether the grippers 151 are ready to grip food loaves. If yes, the gripping operation of step 255 is initiated. If no, the next subsequent step 256 is enabled. Step 256 may also be enabled by an output from step 255. As the food loaf slice groups constituting the output of slicing machine 50 move to position to be weighed on conveyor 132, an appropriate input has been made, prior to this time, by the computer program. In step 256 of the program flow chart, a positive output results in an enabling signal to the next step 257, to cause the machine to weigh each product slice group as it leaves the machine. If the sliced product group (or groups) is not in position for weighing, there is a negative output from step 256, or an output from step 257, supplied to the run loop start step 236 to maintain the slicing machine in operation. Either way, operation continues until a given desired slicing operation is finished.

C. The Shear Edge Members and Adjustments, FIGS. 8–14.

Figure 8:
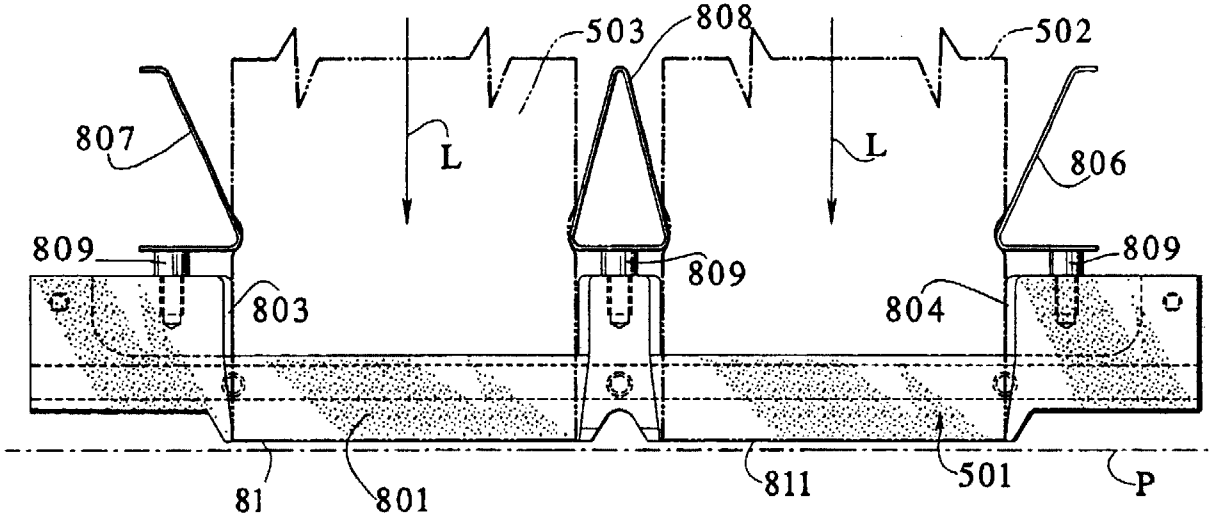
FIGS. 8, 9 and 10 are plan, front elevation, and side views of one shear edge member used in the slicing station of the present invention.
Figure 9:
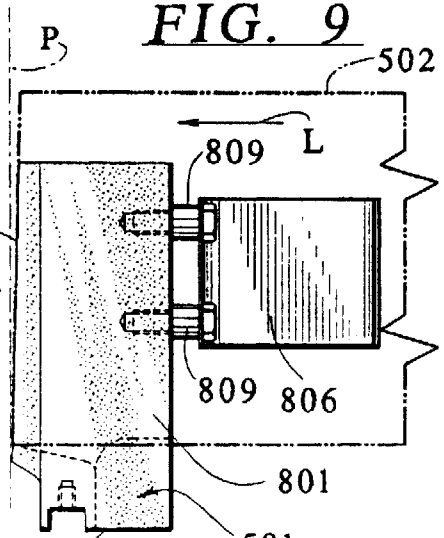
Figure 10:
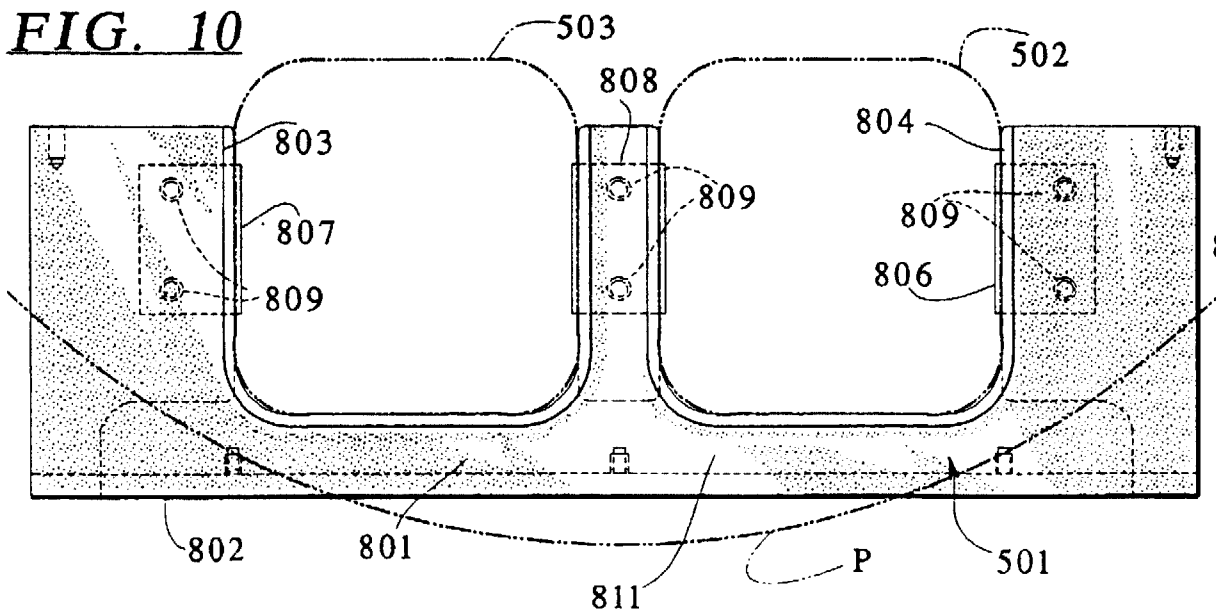

FIGS. 8–10 afford orthagonal views of the shear edge member 501 used to feed two food loaves 502 and 503 into the slicing station; FIG. 8 affords a plan view of the shear edge member, FIG. 9 is an end view, and FIG. 10 is a front elevation view. In machine 50, all of these views would be rotated about 45° because the food loaves enter the slicing station at an angle of approximately 45°.

Shear edge member 501 has a main body 801 formed of a generally rectangular block of a plastic such as nylon. The longest dimension of body 801 is its bottom surface 802 (FIGS. 9 and 10); typically, the overall length of bottom wall 802 is about 13.5 inches (34 cm). The overall height of the plastic block 801 is about 3.5 inches (9 cm). There are two square food loaf openings 803 and 804 to receive food loaves 503 and 502, respectively; see FIGS. 8 and 10. Openings 803 and 804 each have a width determined by the food loaf size; in this instance the food loaves are about four inches (ten cm) square. But the height of the openings 803 and 804 is smaller than the food loaf height, as can best be seen in FIG. 10. The direction of movement of the food loaves into shear edge member 501 is indicated by arrows L, FIGS. 8 and 9.

At the right hand side of shear edge member 501, FIGS. 8 and 10, there is a resilient metal guide member 806 that engages the side of food loaf 502. Guide 806 also appears in FIG. 9. A similar resilient metal guide member 807 on the other side of shear edge member 501 engages the side of food loaf 503. A centrally located resilient guide member 808 (FIGS. 8 and 10) contacts and guides the adjacent sides of the two food loaves 502 and 503. All of the guides 806–808 may be mounted on the main body 801 of shear edge member 501 by mounting studs 809 or other appropriate means.

The front surface 811 of shear edge member body 801, which projects outwardly from body 801 (see FIGS. 8–10) should conform closely to the path P of the cutting edge of the knife blade 149 in slicing station 66. Because there may be some irregularities in the knife blade contour or in its mounting in the slicing station, it may be desirable to trim surface 811 with the knife blade to be certain that conformity is established and maintained. Indeed, it may be desirable to trim surface 811 of the shear edge member after each sharpening of the slicing station knife blade.

Figure 11:
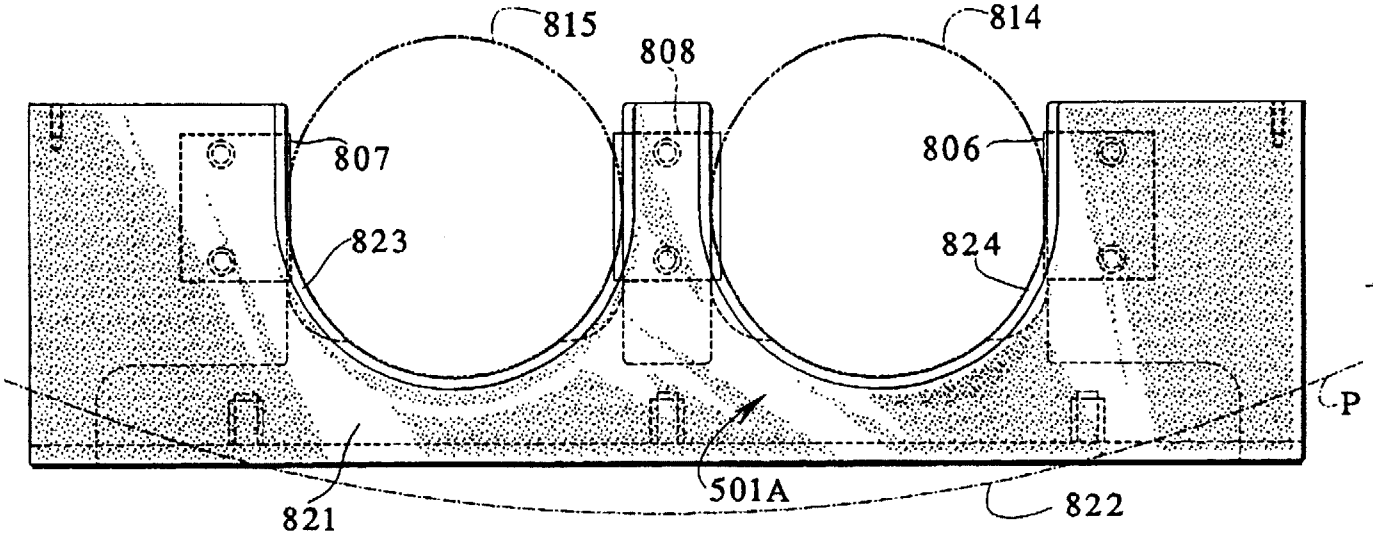
FIGS. 11 and 12 are front elevation views, like FIG. 10, of other shear edge members usable in the slicing station of the present invention.

FIG. 11 is a front elevation view, like FIG. 10, of a shear edge member 501A used to feed two food loaves 814 and 815 into the slicing station. As in the case of FIGS. 8–10, FIG. 11 is actually at an angle, looking upwardly, of 45°, because that is the angle at which food loaves enter the slicing station. Shear edge member 501A has a main body 821 again preferably formed of a block of a machinable resin such as nylon. The longest dimension of body 821 is its bottom 822, which again may be about 13.5 inches (34 cm). The overall height of the plastic body 821, as shown, is about 3.5 inches (9 cm); it is for use with round loaves 814 and 815 having a diameter of about 3.5 inches, so that the round food loaves each project above their respective openings 824 and 823.

Shear edge member 501A has three resilient metal guide members 806, 807 and 808, aligned and mounted on member 501A in the manner previously described. Guides 806–808 serve the same basic function in shear edge member 501A as in member 501; they guide food loaves 814 and 815 squarely into openings 824 and 823.

Figure 12:
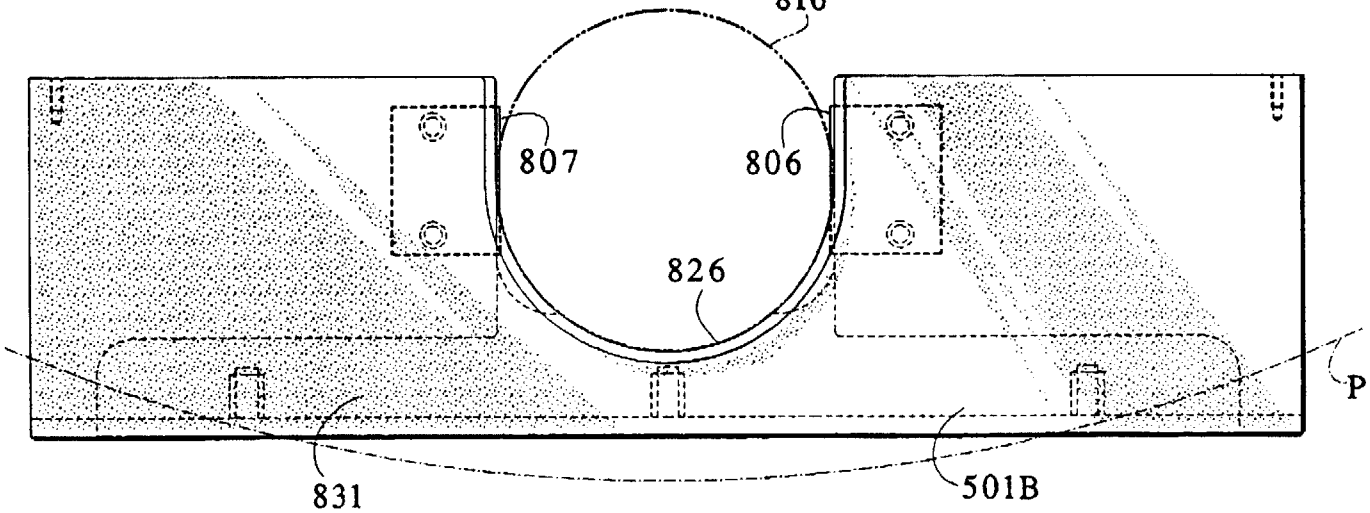

Another shear edge member 501B is shown in front elevation, subject to a 45° tilt, in FIG. 12. Member 501B is different from the previously described shear edge members 501 and 501A; it serves just one food loaf 816. Loaf 816 has a diameter of about 3.5 inches (9 cm), like one of the loaves shown in FIG. 11. Loaf 816 is centered in an opening 826 in the body 831 of shear edge member 501B. In this instance there are just the two resilient metal guides 806 and 807, engaging opposite lateral sides of loaf 816.

The knife path P in FIGS. 11 and 12 is approximately the same as in FIG. 10; for smaller loaves it may be desirable to adjust the shear edge member down toward path P. For larger loaves, some elevation of the shear edge member (and consequent elevation of the cut face of each food loaf) may be necessary. The mounting for the shear edge members should provide for such vertical adjustment; indeed, the vertical adjustment should apply to the complete loaf feed mechanism 75 adjacent the entry of the food loaves into the slicing mechanism.

There is a shear edge member for each size and shape of food loaf sliced in slicing station 66. Food loaves are most commonly cut in pairs, in machine 50 (FIGS. 1–3) but if only one loaf is to be cut, the machine must be equipped with a shear edge member for one loaf of that particular size and shape; see FIG. 12. Alignment of the food loaves with knife 149 and its cutting path P in slicing station 66 (FIGS. 3 and 4) is assured by metal guides 806–808, FIGS. 8–12; a skewed food loaf would result in poor slices and would almost certainly be out of the permissible weight tolerance range. In all of the shear edge members (those shown in FIGS. 8–12 are merely exemplary) each loaf is engaged on three sides, left, right and bottom, by the shear edge member and its resilient guides. The top of each loaf is held down by the "short" conveyors 165 and 166, FIGS. 3 and 6. Alignment of the food loaves at the point of slicing, by blade 149, is thus assured.

Figure 14:
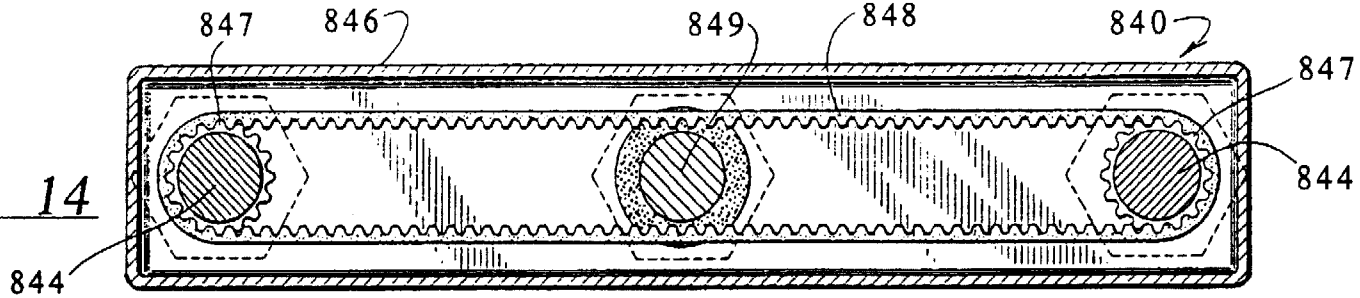
FIG. 14 is a section view taken approximately along line 14—14 in FIG. 13.
Figure 13:
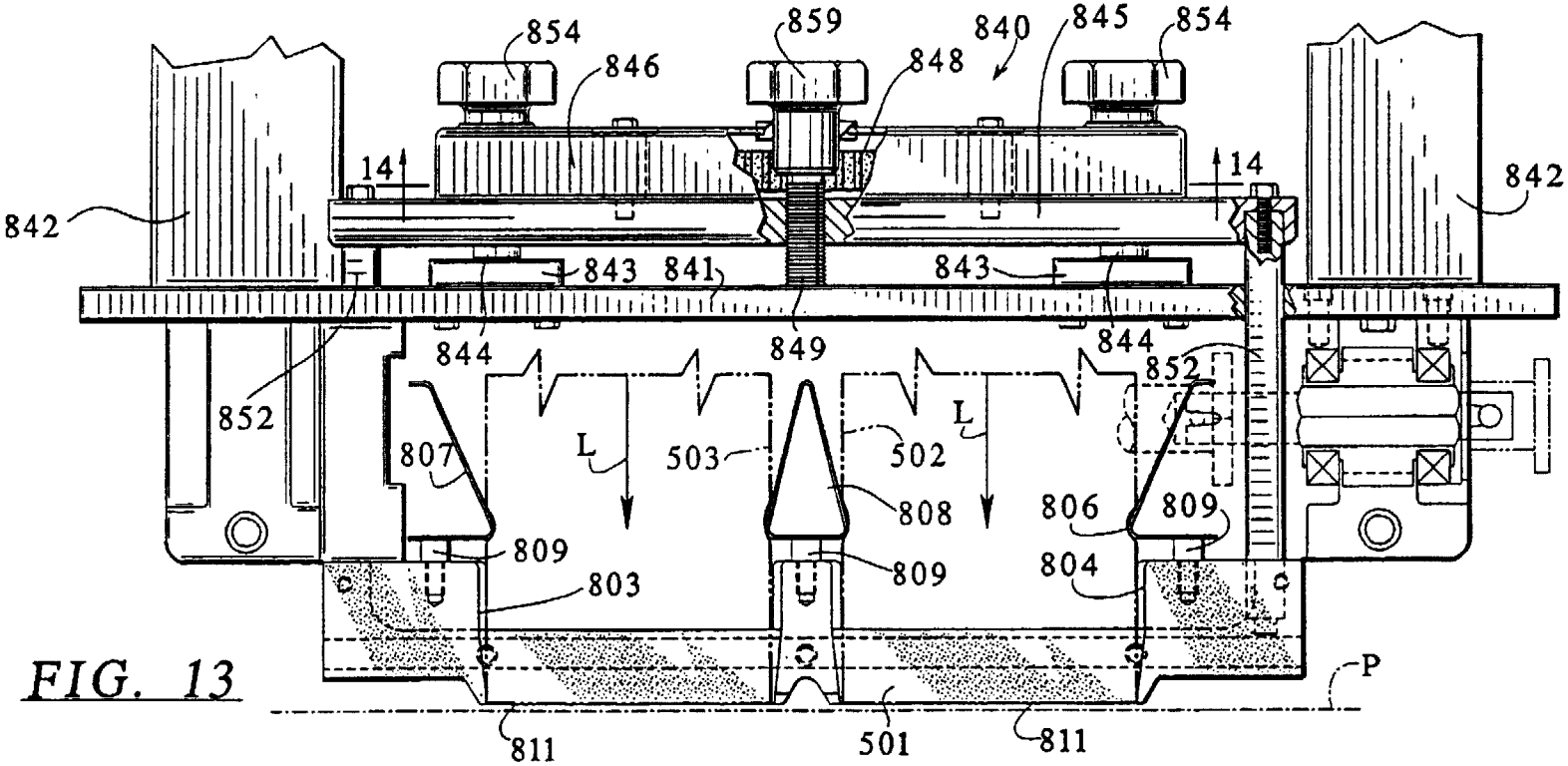
FIG. 13 is a plan view of a horizontal adjustment mechanism for a shear edge member of the kind shown in FIGS. 8–10.

FIGS. 13 and 14 show a shear edge adjustment mechanism 840 used to adjust a shear edge member (e.g., the member 501) toward and away from the path P of the slicing knife blade. Such adjustment is essential to effective operation of the slicing station, to assure clean and accurate cutting of the food loaf slices. FIG. 13 shows shear edge member 501 in a plan view like FIG. 8. Mechanism 840 must move shear edge member 501 smoothly and precisely in the direction of arrows L, the feed direction for food loaves 502 and 503. Canting of shear edge member 501 relative to knife path P is not acceptable, nor is any binding of the adjustment mechanism allowable.

Adjustment mechanism 840, as shown in FIG. 13, is mounted on a support member 841 that extends between two fixed frame members 842. Mechanism 840 includes two pressure blocks 843 mounted on support 841 near opposite ends of the support. Each block 843 is engaged by the end of one of two adjustment shafts 844 threaded through and projecting from a yoke or base 845 and extending through a housing 846 (FIGS. 13 and 14) that is mounted on yoke 845. Within housing 846 each shaft 844 is affixed to a pulley 847; see FIG. 14. Pulleys 847 are each engaged by a timing belt 848.

At the center of adjustment mechanism 840 there is a position-locking shaft 849 threaded into the relatively thick base (yoke) 845 for the housing of adjustment mechanism 840. Shaft 849 engages support member 841. At the opposite ends of base yoke 845 there are two shear edge supports 852 that project from the base parallel to the direction of loaf movement (arrows L). The shear edge member, in this instance member 501, is mounted on and spans the ends of supports 852 opposite base 845 of mechanism 840.

When it becomes expedient to adjust the position of a shear edge member (e.g., member 501) in the direction of arrows L, FIG. 13, the knob 859 on shaft 849 is first turned to release shaft 849 from engagement with the lower yoke 841. One of the adjustment knobs 854 on shafts 844 is then turned to move base 845 toward or away from path P, in the direction of arrows L. Most adjustments are toward path P; occasionally, however, an adjustment away from path P, usually a relatively large movement, occasioned by replacement of the knife blade, is required. Turning knob 854 on one positioning shaft 844 turns the other positioning shaft, due to the timing belt 848 and its engagement with pulleys 847; see FIG. 14. Thus, the entire mechanism 840 moves toward or away from cutting path P; there is and can be no twisting or canting of the mechanism. The shear edge member 501 moves with mechanism 840; it is thus quickly and accurately realigned with path P. When adjustment is complete, knob 859 is again used, this time to tighten shaft 849 against yoke 841 and thus immobilize mechanism 840 with the shear edge member in its new position.

D. The Slicing Station Seal, FIGS. 15–17

FIG. 15 is a schematic sectional plan view of a portion of a slicing station 866 constructed in accordance with the invention. FIGS. 15–17 illustrate a seal that prevents entry of hot water, steam, or other fluids into contact with operating components of the slicing station during clean-up of the slicing machine, as is required at least daily. It will be understood that the previously discussed slicing station 66 of slicing machine 50 incorporates the sealing features of slicing station 866 shown schematically in FIG. 15.

As shown in FIG. 15, slicing station 866 includes a U-shaped housing 865 closed off on one side by a further housing member 863. Housing member 863 has a relatively large opening which the spindle or head 868 for slicing station 866 fills. Spindle 868 corresponds essentially to the previously described spindle or head 148 (FIG. 4); it may be driven by a timing belt 190 that is in turn driven from a servo motor 171 through a shaft 171A and a pulley 171B. Slicing station 866 includes a circular knife blade 869 mounted on a shaft 869A journalled in an appropriate bearing in head 868 that is eccentrically located with respect to the axis of head 868. Blade 869 corresponds in all respects to the previously described slicing knife blade 149. It is driven by a pair of timing belts 191 which, in turn, are driven by motor 172 through a shaft 172A and two spindles 172B and 195. Thus, it will be recognized that the knife blade drive for slicing station 866 of FIG. 15 is essentially the same as described above for slicing station 66; see FIG. 4. A counterweight 868A is mounted on spindle 868 to compensate for the eccentric mounting of blade 869.

A small marker 901 is mounted on the periphery of spindle 868 in slicing station 866, FIG. 15. Thus, marker 901 is mounted on a part of the knife blade drive that moves with knife blade 869 as that blade traverses its cutting path P. Marker 901, in its simplest form, may constitute a permanent magnet. A light source (e.g., a LED) or other such emitter can be used for marker 901 if desired. A sensor 902 is mounted upon the housing member 863 in position to sense the presence of marker 901 at one predetermined location indicative of alignment of knife blade 869 at a home position on its cutting path P. That home position is the position illustrated in FIG. 15. Of course, if marker 901 is a light source, sensor 902 should be some form of photodetector. For any position other than the home position, marker 901 and sensor 902 are out of alignment with each other. Stated differently, these two elements are in alignment with each other only when knife blade 869 is in its predetermined home position, determined by the rotational orientation of head 868.

As best shown in FIG. 16, the orbiting head or spindle 868 is provided with a slot or groove 851 that extends around its periphery. A resilient elastomer ring 864 is mounted in slot 851 An ordinary rubber or synthetic elastomer "O" ring is suitable. Other cross-sectional configurations for ring 864 may be employed. In the normal non-sealing position shown in FIG. 16, O-ring 864 blocks a passage 871 that connects to a passage 870 in a member 872 when spindle 868 is in its home position. Passage 870, in turn, is connected to a valve 873 in a compressed air line 874. In FIG. 16, the components, particularly O-ring 864, are shown in the positions that they occupy with valve 873 closed. In FIG. 17, however, it is assumed that valve 873 is open to supply air under pressure through passageways 870 and 871 to impinge upon the interior of O-ring 864 in groove 851. In these circumstances, O-ring 864 is pushed outwardly against the rim of frame member 863, effectively sealing the periphery of spindle head 868 so that no water or steam can enter the interior of housing 865 (FIG. 15).

When a slicing run has finished, in the operation of a slicing machine in which station 866 (FIGS. 15–17) is incorporated, a clean-up operation is necessary. At this point, the slicing machine is shut down. Motor 171 may be briefly energized or jogged to turn spindle 868 slowly until marker 901 is approximately aligned with sensor 902. Thereafter, the manual adjustment mechanism for rotation of spindle 868, shown as the large knob 161 at the right-hand side of station 866, is used to rotate spindle 868 until members 901 and 902 are accurately and precisely aligned. This is the home position for spindle 868 and for the knife blade 869 of slicing station 866.

With slicing station 866 in its home position orientation, as shown in FIG. 15, the passage 870 through member 872 (FIGS. 16 and 17) is aligned with the passage 871 in the periphery of spindle 868. Initially, there is no seal because valve 873 is closed; the condition is as shown in FIG. 16. However, since the home position for the slicing station has been achieved, valve 873 is now opened to introduce air under pressure into the back of the groove 851 containing O-ring 864, on the side of O-ring 864 opposite frame member 863. As a consequence, the O-ring is driven against frame member 863 and seals off the interior of the housing of slicing station 866, as shown in FIG. 17. As long as this sealed condition is maintained, hot water, soap, and steam cannot enter slicing station housing 865. As a consequence, materially increased working life can be anticipated for the drive components in the slicing station housing.

E. The Honing Mechanism, FIGS. 18, 18A, and 19

FIGS. 18 and 19 illustrate a blade honing or sharpening device 920 used with the slicing station of the present invention; FIG. 18A is a simplified schematic circuit diagram used to explain one aspect of operation of the honing device. In considering FIGS. 18, 18A and 19, it should be assumed that the blade 869 (or 149) of the slicing station 866 (or 66) has been located in its predetermined home position, the position indicated by dash outline 921 in FIG. 18. The blade axis is indicated at 924. This puts the cutting edge of the blade in the position 922 in FIG. 19. One of the other orbital positions for the knife blade is indicated by outline 925.

Honing device 920, FIGS. 18 and 19, comprises a housing 923 having an outer surface which should conform in configuration to a part of the wall of the slicing station. Housing 923 includes two mounting devices 931 and 932 (FIG. 18) for mounting housing 923 on the side of the slicing station housing wall 927 (FIG. 19). There is an opening 928 in housing 923, as shown in FIG. 18, that exposes much of the central area of the knife blade in its home position 921. The peripheral cutting edge of the knife blade, however, is covered by housing 923 except at a second opening 929 in the housing; see FIGS. 18 and 19.

The two mounting devices 931 and 932 mount honing device 920 on the slicing station in the desired orientation to the home position 921 of the slicing blade, as shown in FIGS. 18 and 19. Device 931, FIG. 18, may be a conventional mounting device; indeed, there may be two or more such mounting devices. Mounting device 932, however, serves an additional purpose. It includes a plunger 933 that extends into alignment with a switch 934, as shown in FIG. 19. The relationship of plunger 933 to switch 934 is such that the switch is actuated from one operating condition to another whenever the plunger is aligned with the switch. That is, mounting of honing device 920 in place on the slicing station housing wall 927 causes switch 934 to be actuated. In the simplified circuit illustrated in FIG. 18A switch 934 is shown as a normally closed device in the energizing circuit for spindle drive motor 171. Switch 934 is opened by mounting device 932 of honing apparatus 920. Consequently, when honing device 920 is in place spindle drive motor 171 cannot be energized; the knife blade remains in its "home" position 921 (FIG. 18). However, the knife blade can be rotated while in its home position because knife blade drive motor 172 can still be energized. It will be recognized that there are other comparable control arrangements for preventing operation of the spindle drive, particularly motor 171, when housing device 920 is in place ready to hone or sharpen the knife blade.

The blade honing or sharpening mechanism 935 of device 920 includes two abrasive honing wheels or stones 936 and 937 which engage opposite sides of blade edge 922. Both are mounted on a carriage 938; a shaft connector 939 projects outwardly from the carriage and can be turned as indicated by arrow N in FIG. 18 to move sharpening mechanism 935 toward or away from the blade to be sharpened.

In use, the honing (sharpening) device 920 is mounted on the slicing station with honing mechanism 935 out of engagement with the blade. This is accomplished using mounting devices 931 and 932; switch 934 (FIGS. 18A and 19) is opened by mounting device 932, as described, to assure that the spindle drive motor cannot be activated and that the knife blade will remain in its "home" position 921. The honing mechanism is then advanced to bring honing wheels 936 and 937 into engagement with the cutting edge of the slicing blade, utilizing connector 939. The knife blade drive motor 172 can now be energized, rotating the knife blade, preferably at a slow rate. In this way, the abrasive honing wheels 936 and 937 can hone the entire peripheral cutting edge of the circular knife blade. Although one honing wheel, such as wheel 936, would sharpen the knife blade, it could leave a rough burr on the opposite surface of the knife blade. That is why two honing wheels are preferred. Of course, one honing device 920, of the kind shown in FIGS. 18–19, can serve several knife blades in different slicing stations.

F. An Alternate Blade, FIG. 20

Figure 20:
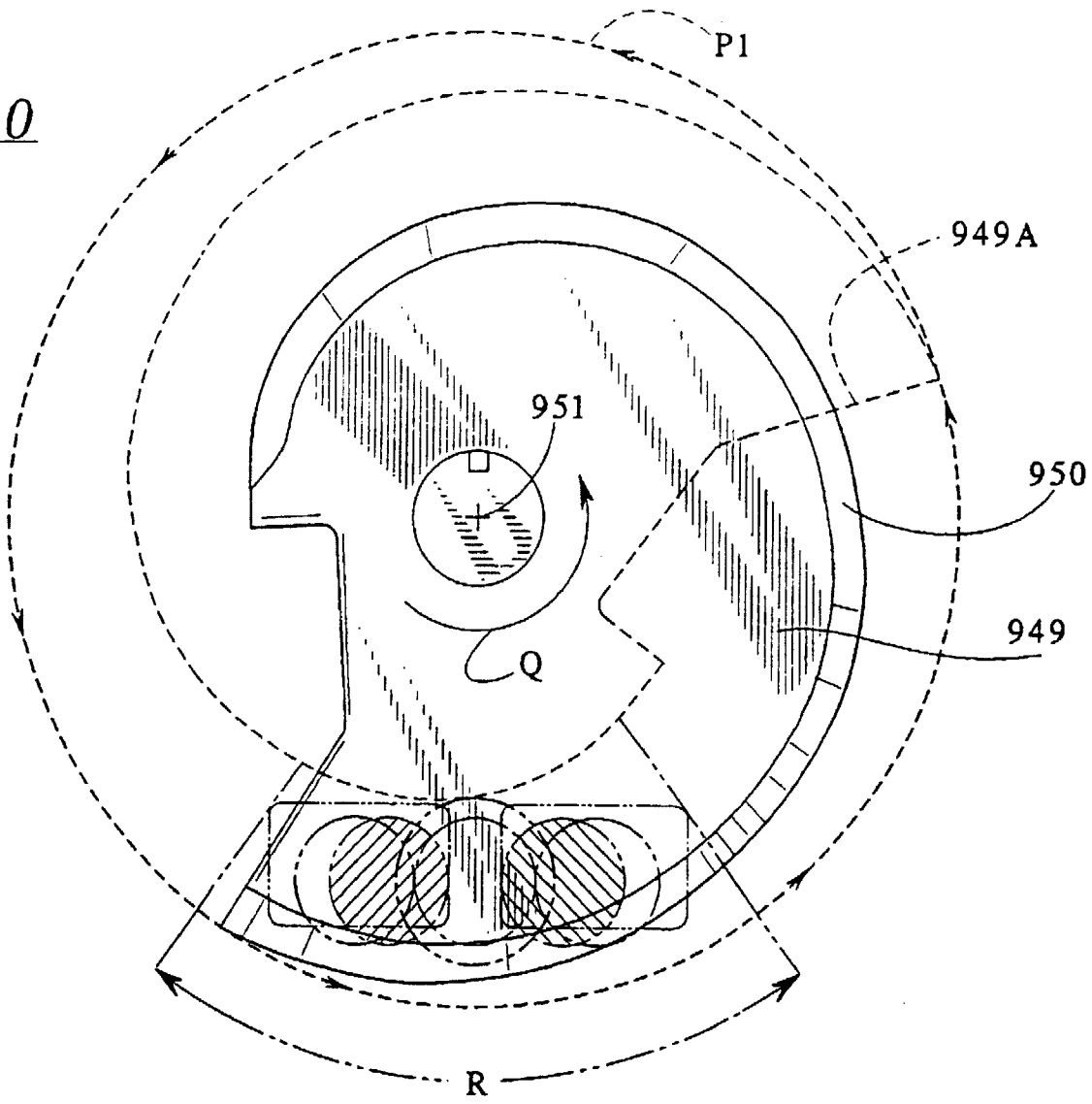
FIG. 20 is a schematic drawing showing a different type of knife blade usable in some forms of the slicing station of the invention.

FIG. 20 shows a knife blade 949 having an involute cutting edge 950. Blade 949 is rotatable about an axis 951, preferably counterclockwise as indicated by arrow Q. The cutting path for the outermost point on blade 949 is shown by dash line P1; it will be apparent that the entire cutting path is much broader. Alignment of blade 949 relative to food loaves of various sizes and shapes is shown in FIG. 20; the cutting of the food loaves occurs in an arcuate range R, for rotation of blade 949, of about 75° for the largest pair of food loaves illustrated in FIG. 20.

FIG. 20 also shows another position 949A for blade 949 as it rotates about axis 951. Blade position 949A is displaced about 140° from blade position 949; at position 949A the blade does not cut any of the food loaves. The portion of path P1 in which blade 949 does no slicing, even for the largest loaves, is usually about 70°.

Blade 949 has an advantage, as compared with the circular knife blades of previously described slicing stations, in that it does not need an orbiting motion and hence allows for elimination of the spindle and the spindle drive. But blade 949 is not suitable for use with the honing device 920 of FIGS. 18 and 19; that honing device is based on a knife blade of constant diameter. However blade 949 can be mounted on a spindle with an O-ring or the like for sealing the slicing head and drive components during clean up; see FIGS. 15–17. Other conventional blade configurations can also be utilized in slicing stations incorporating features of the invention.

We claim:

1. A slicing station for a high speed food loaf slicing machine, said slicing machine including food loaf support means defining a food loaf path, loaf feed means for feeding a food loaf along the food loaf path toward said slicing station, and receiving means for collecting and removing groups of food loaf slices cut from the food loaf at said slicing station, said slicing station being located at one end of the food loaf path, said slicing station comprising:

a knife blade movable along a predetermined cutting path through a slicing range intersecting the end of a food loaf on the food loaf path;

a cyclic drive, connected to the knife blade, for driving the knife blade cyclically along its cutting path at a predetermined cycle rate;

a shear edge member for guiding the end of a food loaf from the food loaf path into the cutting path of the knife blade;

the shear edge member comprising an elongated block having at least one loaf-receiving opening for receiving one end of a food loaf on the food loaf path;

shear edge mounting means for mounting the shear edge member for movement in a predetermined direction toward and away from the knife blade cutting path;

the shear edge mounting means including an elongated yoke disposed in parallel spaced relation to the shear edge member, and a pair of spaced supports projecting from the yoke into engaging and supporting relation to the shear edge member;

and shear edge adjustment means, including a plurality of adjustment shafts threaded into the shear edge mounting yoke, for adjusting the shear edge member toward and away from the cutting path of the knife blade.

2. A slicing station for a food loaf slicing machine according to claim 1 in which the shear edge adjustment means further includes a timing belt encompassing and engaging all of the adjustment shafts so that movement of one adjustment shaft moves all other adjustment shafts equally.

3. A slicing station for a food loaf slicing machine according to claim 1 in which:

the shear edge member further comprises a plurality of resilient guides for guiding the food loaf into the loaf-receiving opening in a direction parallel to the predetermined direction.

* * * * *